US006215967B1

(12) United States Patent
Takeda et al.

(10) Patent No.: US 6,215,967 B1
(45) Date of Patent: Apr. 10, 2001

(54) IMAGE FORMING APPARATUS WITH A CONTROLLED CLEANING OPERATION FEATURE

(75) Inventors: Atsushi Takeda, Mishima; Fumiteru Gomi, Shizuoka-ken; Kouichi Hashimoto, Numazu; Yoshiyuki Komiya, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/219,602

(22) Filed: Dec. 23, 1998

(30) Foreign Application Priority Data

Dec. 25, 1997 (JP) ..... 9-357270
Dec. 25, 1997 (JP) ..... 9-357271

(51) Int. Cl.[7] ..... G03G 15/00; G03G 15/24

(52) U.S. Cl. ..... 399/43; 399/71; 399/148; 399/149; 399/150

(58) Field of Search ..... 399/148–150, 399/43, 71

(56) References Cited

U.S. PATENT DOCUMENTS 5,196,892 * 3/1993 Mitsuaki ..... 399/150
5,221,946 * 6/1993 Kohyama ..... 399/150
5,541,717 * 7/1996 Saito et al. ..... 399/150
5,587,774 * 12/1996 Nagahara et al. ..... 399/150
5,724,633 * 3/1998 Amemiya ..... 399/303 X
5,765,076 * 6/1998 Ogata et al. ..... 399/149 X
5,822,659 * 10/1998 Ishiyama ..... 399/150 X
5,835,821 11/1998 Suzuki et al. ..... 399/100
5,937,245 * 9/1999 Inoue et al. ..... 399/150 X
5,970,285 * 10/1999 Ito et al. ..... 399/149

FOREIGN PATENT DOCUMENTS 6-3921 1/1994 (JP) .

* cited by examiner

*Primary Examiner*—William J. Royer
(74) *Attorney, Agent, or Firm*—Fitzpatrick, Cella, Harper & Scinto

(57) ABSTRACT

An image forming apparatus includes an image bearing member for bearing a toner image and a transfer device for transferring the toner image from the image bearing member onto a transfer material. A charging member contacts a surface of the image bearing member from which residual toner is not removed to electrically charge the image bearing member. The charging member is capable of temporarily collecting the residual toner. A cleaning device applies, to the charging member, a cleaning voltage for returning the toner to the image bearing member. An image forming device forms an electrostatic image on the image bearing member having been charged by the charging device. A developing device develops the electrostatic image on the image bearing member and collects the toner from the image bearing member. A controller controls the cleaning device to vary a cleaning condition of the charging member.

8 Claims, 12 Drawing Sheets

IMAGE FORMING APPARATUS WITH A CONTROLLED CLEANING OPERATION FEATURE

FIELD OF THE INVENTION AND RELATED ART

The present invention relates to an image forming apparatus such as an electrophotographic copying machine and an electrophotographic printer, which is equipped with a charging member, which is placeable in contact with an image bearing member, and to which voltage is applied to charge the image bearing member FIG. 12 is a schematic vertical section of a conventional image forming apparatus of a transfer type (copying machine, printer, facsimile, and the like), and depicts the general structure thereof.

Reference character 101 designates an electrophotographic photosensitive member (hereinafter, "photosensitive drum") as an image bearing member, in the form of a rotative drum, which is rotatively driven at a predetermined peripheral velocity in the counterclockwise direction indicated by an arrow mark.

In each image formation cycle, the photosensitive drum 101 is exposed to the light from a pre-exposing device 102 (eraser lamp) across its entire peripheral surface, before it is charged for image formation. This process is carried out to erase the electrical memory which the photosensitive drum 101 might have acquired during the proceeding image formation cycle. Then, the photosensitive drum 101 is subjected to a charging process in which it is uniformly charged to predetermined polarity and potential level by a corona based charging device 103 as a charging means. Then, the charged photosensitive drum 101 is exposed with a beam of image formation light L from an unillustrated exposing means (means for projecting the image of an original onto the photosensitive drum 101; means for projecting a scanning laser beam modulated with image formation data; and the like means) to form an electrostatic latent image, that is, a latent pattern formed as the electrical charge is selectively removed, or reduced in potential level, from the uniformly charged peripheral surface of the photosensitive drum 101, by the aforementioned beam of image formation light L. The thus formed electrostatic latent image is developed into a toner image by a toner based developing apparatus 104 as a developing means.

Meanwhile, a piece of transfer medium P (transfer paper) as a recording medium is fed into the image forming apparatus by an unillustrated sheet feeding mechanism, between the photosensitive drum 101 and a corona based charging device 105 as a transferring means, with a controlled timing. As the transfer medium P is passed between the photosensitive drum 101 and the corona based charging device 105, the transfer medium P is charged to the polarity opposite to the potential of the toner, on the side of the transfer medium P which is not facing the photosensitive drum 101. As a result, the toner image on the photosensitive drum 101 is electrostatically transferred onto the transfer medium P, on the side which is facing the photosensitive drum 101.

Next, the transfer medium P is electrostatically separated from the peripheral surface of the rotating photosensitive drum 101 by a conona based charging device 106, and is introduced into an unillustrated fixing apparatus, in which the toner image is fixed to the transfer medium P. Then, finally, the transfer medium P with the toner image fixed thereto is outputted as a copy or a print, from the image forming apparatus.

In the case of an image forming apparatus which outputs an image of two or more colors, it is equipped with a plurality of image formation stations, each of which is provided with its own processing devices, and each station works in synchronism with the conveyance of the transfer medium to place in layers a toner image of a specific color on the transfer medium, which generally is being conveyed by a dedicated transfer conveying member. After two or more toner images of a specific color are deposited on the transfer medium, the transfer medium is separated from the transfer medium conveying member, and is introduced into the fixing apparatus, in which the toner images are fixed to the transfer medium. Thereafter, the transfer medium with two or more toner images fixed thereto is outputted as a multicolor or full-color copy, or print, from the image forming apparatus.

After the toner image transfer onto the transfer medium, the peripheral surface of the photosensitive drum 101 is cleaned by the cleaning apparatus 107 (cleaner); the toner which remains on the peripheral surface of the photosensitive drum 101 is removed so that the photosensitive drum 101 can be used for the following image formation cycle.

There are various structures for the photosensitive member as the image bearing member, and for the means for carrying out the aforementioned image formation processes, that is, the charging, exposing, developing, transferring, fixing, cleaning, and the like processes. Also, there are various image formation systems.

For example, there is a corona based charging device, which has long been widely used as the charging means 103. The corona based charging device is positioned immediately next to the photosensitive drum, without any contact with the photosensitive drum, and the peripheral surface of the photosensitive drum is exposed on the corona discharged from this device so that the peripheral surface of the photosensitive drum is charged to predetermined polarity and potential level.

In recent years, however, contact type charging apparatuses have been developed, and some of them have been put to practical use because of advantages such as producing a smaller amount of ozone, and consuming a smaller amount of electric power, compared to the conona based charging apparatus. In the case of the contact type charging apparatus, the peripheral surface of the photosensitive drum is charged to the predetermined polarity and potential level by applying voltage to a contact type charging member placed in contact with the peripheral surface of the photosensitive drum.

There are various contact type charging members, but a magnetic brush type charging member is favorably used because of its reliability. The magnetic brush type charging member comprises a magnetic brush portion, which consists of magnetic particles confined magnetically in the form of a brush. In charging the photosensitive drum, this magnetic brush portion is placed in contact with the peripheral surface of the photosensitive drum.

More specifically, the magnetic brush portion of the magnetic brush type charging member consists of electrically conductive magnetic particles confined magnetically in the form of a brush, directly on the magnet, or on the peripheral surface of a sleeve in which a magnet is disposed. In order to charge the photosensitive drum, the magnetic brush portion of the magnetic brush type charging member, which may be stationary or rotating, is placed in contact with the peripheral surface, and voltage is applied to the photosensitive drum.

There are other contact type charging members which have been used as a desirable contact type charging member;

for example, a brush formed of stands of electrically conductive fiber (fur brush type charging member), a roller formed of electrically conductive rubber (charge roller), and the like.

This contact type charging member is remarkably effective when used to charge an organic photosensitive drum, or the object to be charged, the surface layer (charge injection layer) of which is composed of material in which electrically conductive particles have been dispersed, or a photosensitive member based on amorphous silicon, because such a combination makes it possible to charge the peripheral surface of the photosensitive member to a level substantially equal to the potential level of the DC component of the bias applied to the contact type charging member (Japanese Laid-Open Patent Application No. 3921/1994).

A charging method such as the one described above is called "charge injection". Since this type of charging method (method which directly injects electrical charge into an object to be charged) does not rely on the electrical discharge which the corona type charging device uses, it does not generate ozone, and also consumes a smaller amount of electrical power. Therefore, it has been attracting much attention.

Meanwhile, an image formation apparatus has been reduced in size as the aforementioned processing means or devices such as the charging, exposing, developing, transferring, fixing, and cleaning means or device, and the like, have been reduced in size. However, there is a certain limit to the reduction, in terms of the overall size of an image forming apparatus, which can be accomplished by reducing the sizes of these means and devices.

As was described above, the toner (residual toner particles) which remains on the photosensitive drum 101 after the image transfer are recovered by the cleaner 107 as waste toner particles, which are desired not to be produced from the point of view of environmental protection, as well as the obvious other reason. Thus, a group of image forming apparatuses based on the so-called "cleanerless system" have appeared. They do not have the aforementioned cleaner 107, and the residual toner particles on the photosensitive drum 101 are removed, that is, recovered, by the developing apparatus 104 at the same time as the latent image is developed, so that the residual toner particles can be used again.

This cleaning-while-developing method is such a method that recovers the small amount of toner, which remains on the photosensitive drum 101 after the image transfer, by the fog removing bias (difference Vback between the level of the DC voltage applied to the developing apparatus and the level of the surface potential of the photosensitive drum 101) during the following image formation cycle. According to this method, the residual toner is recovered by the developing apparatus 104 and is used in the following image formation cycle. In other words, the waste toner is not produced, and the maintenance which is related to the waste toner may be eliminated. Being cleanerless offers another big advantage in terms of space; an image forming apparatus can be drastically reduced in size.

A contact type charging apparatus has its own problems. For example, its contact type charging member placed in contact with an object to be charged picks up the contamination, or the foregoing substance, on the object to be charged; in other wards, the contact type charging member is easily contaminated (contact type charging member is easily deteriorated). If the amount of the contaminant exceeds a certain level, a charging apparatus becomes inferior in performance; it fails to charge the object to be charged to the desired potential level, and/or it nonuniformly charges the object to be charged.

Further, even in the case of an image forming apparatus which employs a contact type charging apparatus as a means for charging an image bearing member such as a photosensitive member, and also a cleaner dedicated for cleaning the toner which remains on the image bearing member after image transfer, toner particles, and the so-called external additives such as silica, which are contained in developer, pass by the cleaner. The amount of these particles is rather small, but as the image formation cycle is repeated, they are continuously carried to the contact type charging member by the movement of the image bearing member, adhering or mixing into the contact type charging member. In other words, even in the case of an image forming apparatus equipped with the aforementioned dedicated cleaner, the contact type charging member is likely to be contaminated.

Normally, the electrical resistance of toner particles, silica particles, or the like, is substantially high compared to that of a charging member. Therefore, if the toner particles, silica particles, and/or the like adhere to, or mix into, the contact type charging member, by an amount which exceeds a certain level, that is, if the contact type charging member is saturated with the contaminant, the electrical resistance of the contact type charging member increases in some parts, or in its entirety, which makes it impossible for the contact type charging member to charge the image bearing member to the desired potential level, and/or makes the contact type charging member nonuniformly charge the image bearing member, which in turn causes the image forming apparatus to produce inferior images.

This contamination of the contact type charging member by the toner particles, and the resultant production of inferior images are conspicuous, in particular, in the case of the aforementioned cleanerless image forming apparatus, that is, an image forming apparatus which is not equipped with a cleaner dedicated for removing the toner which remains on the image bearing member after image transfer.

This is due to the following cause. That is, in the case of a cleanerless image forming apparatus, the toner which remains on the image bearing member after image transfer is directly carried to the contact type charging member by the continuous movement of the image bearing member, and adheres to, and/or mixes into the contact type charging member. Therefore, the contact type charging member becomes quickly and excessively contaminated with the toner.

Also in recent years, as the number of copying machines and printers which are introduced into various offices or the like has increased, demand for image forming apparatuses with higher efficiency, that is, image forming apparatuses, the operations of which other than the printing operation take an extremely short time. That is because when the number of prints which each job (sequence from the starting of an image forming apparatus until the end of the last post-image formation processes) requires is small, the time spend for the operations other than the actual printing operation is rather long, somewhat unreasonably so, compared to the time spent for the actual printing.

This is also true in the case of an image forming apparatus capable of outputting images of two or more colors.

SUMMARY OF THE INVENTION

The primary object of the present invention is to provide an image forming apparatus which reduces as much as possible the time spent for the operations other than the actual image forming operation.

Another object of the present invention is to provide an image forming apparatus in which charge failure or nonuniform charge traceable to charging member contamination does not occur.

Another object of the present invention is to provide an image forming apparatus, the charging member of which maintains its peak charging performance for a long time.

Another object of the present invention is to provide an image forming apparatus which can change the conditions, under which the charging member is cleaned, depending on job length.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1 (FIGS. 1–4)

Figure 1:
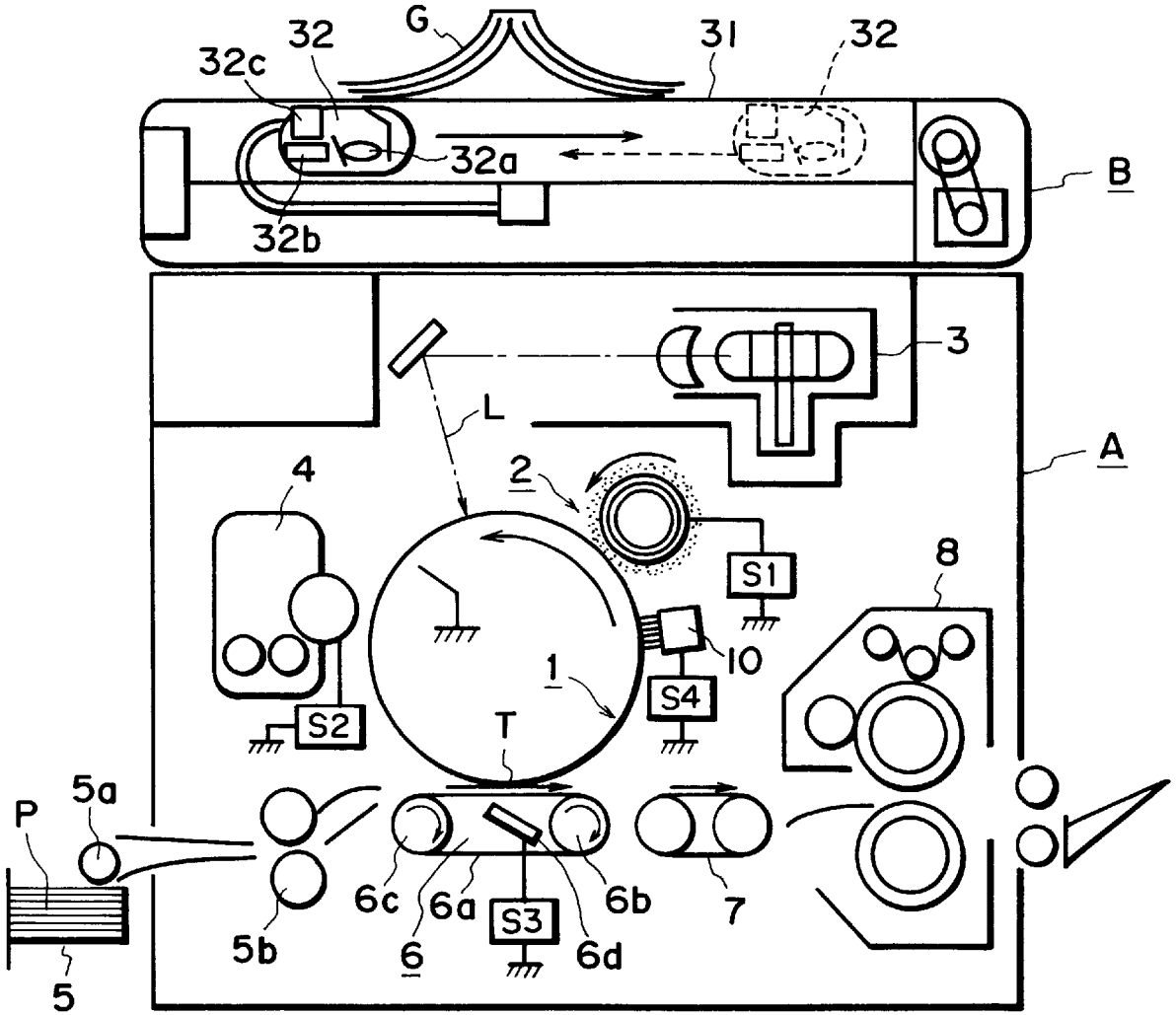
FIG. 1 is a vertical section of an image forming apparatus in the first embodiment of the present invention, and depicts the general structure the image forming apparatus.

(1) General Structure of Image Forming Apparatus (FIG. 1)

FIG. 1 is a vertical section of an image forming apparatus in this embodiment of the present invention, and depicts the general structure of the apparatus. The image forming apparatus in this embodiment is a laser beam printer which uses a transfer type electrophotographic image formation process.

Reference characters A and B designate a laser beam printer, and an image scanner mounted on the laser beam printer, respectively.

a) Scanner B

Regarding the image scanner B, reference character 31 designates a fixed original placement glass platen located at the top of the apparatus. In a copying operation, an original is set on this glass platen 31. More specifically, it is placed on the top surface of this glass platen 31, with the image to be copied facing downward, and is covered with an unillustrated original pressing plate.

Reference character 32 designates a scanner unit, which comprises a lamp 32*a* for illuminating an original, a lens array 32*b* with a short focal point, a CCD sensor 32*c*, and the like. As an unillustrated copy button is pressed, thus unit 32 is caused to move rightward along the bottom side of the platen glass 31 from the home position outlined with solid lines at the left edge of the glass platen 31, and then, to move backward to the starting position, that is, the home position outlined by the solid lines, after reaching a predetermined point.

While the unit 32 is moved toward the turnabout point, the downward facing surface, or the image bearing surface, of the original G placed on the original placement glass platen 31 is scanned rightward by the unit 32, while being illuminated by the original illumination lamp 32*a*, starting from the left edge of the platen 31. As the image bearing surface is scanned, the light reflected by the image bearing surface is focused into the CCD sensor 32*c* by the lens array 32*b* with the short focal point.

The CCD sensor 32*c* consists of a light receptor portion, a transfer portion, and an output portion. The signals in the form of light are received, and converted into signals in the form of electrical potential, by the light receptor portion of the CCD sensor 32*c*. Then, the thus formed signals in the form of electrical potential are sequentially transferred to the output portion in synchronism with clock pulses by the transfer portion. The output portion converts the signals in the form of electrical potential into signals in the form of voltage, amplifies them, reduces them in impedance, and outputs them. The thus obtained analog signals are converted into digital signals through a known image processing routine, and then are sent to a printer A. When an image to be scanned in is a multicolor image, the image is desired to be separated into primary color images with the use of CCD's different in filter.

In other words, the image information regarding the original G is read by the scanner B, and is outputted in the form of sequential digital electrical signals (image formation signals) by the scanner B.

b) Printer A

Whether a monochromatic image is formed with the use of a single unit of image forming means, or a multicolor image is formed with the use of two or more image forming means, the image forming process used by each unit of image forming means is essentially the same as the one used in the other units of image forming means. Therefore, the structure and operation of an image forming apparatus will be described with reference to a monochromatic image forming apparatus.

In printer A, reference character 1 designates an electrophotographic photosensitive member (photosensitive drum) as an image bearing member in the form of a rotative drum. The photosensitive drum 1 in this embodiment is provided with a charge injection layer, which is formed of negatively chargeable organic photoconductive material, and constitutes the top layer of the photosensitive drum 1. This photosensitive member 1 will be described later in Section 2.

The photosensitive drum 1 is rotatively driven in the counterclockwise direction indicated by an arrow mark, about the center axis, at a predetermined peripheral surface velocity, which is 100 mm/sec in this embodiment. As it is rotatively driven, its peripheral surface is uniformly charged to a negative potential level by a charging means 2.

The charging means 2 in this embodiment is a contact type charging apparatus which employs a magnetic brush. This charging apparatus 2 will be described later in detail in Section 3.

The uniformly charged peripheral surface of the rotating photosensitive drum 1 is exposed to a scanning laser beam L, which is modulated with the image formation signal sent from the scanner B side to the printer A side, and is outputted from a laser scanner 3. As a result, an electrostatic latent image which reflects the image formation data photoelectrically read from the original G by the image scanner B is progressively formed on the peripheral surface of the photosensitive drum 1, starting from one end of the image.

The laser scanner 3 consists of a light emission signal illumination signal generator, a solid-state laser element, a collimator lens system, a rotative polygonal mirror, and the like.

The peripheral surface of the rotating photosensitive drum is exposed to a scanning laser beam L projected from the laser scanner 3 in the following manner. First, the image formation signals are inputted into the light emission generator, in which light emission signals modulated with the image formation signals are generated. Then, the solid-state laser is turned on and off at a predetermined frequency, by the light emission signal modulated with the image formation signals, whereby the laser beam L modulated with the image formation signals is emitted from the solid-state laser scanner 3. Then, the flux of the laser beam L emitted from the solid-state laser is rendered substantially parallel by the collimator lens system. Next, it is reflected by the polygonal mirror, which is being rotated at a high velocity in the counterclockwise direction indicated by an arrow mark. As a result, the laser beam L is caused to make scanning movements, while being focused into a spot on the peripheral surface of photosensitive drum 1 by an f-θ lens group. In other words, the peripheral surface of the photosensitive drum 1 is scanned once in the direction perpendicular to its rotational direction by the laser beam L modulated with the image formation signal. As a result, a portion of a latent image, which is equivalent to a single scanning run of the laser scanner 3, is formed on the peripheral surface of the photosensitive drum 1. Then, before the laser scanner 3 starts the following scanning run, the photosensitive drum 1 is rotated by a predetermined angle to scroll the peripheral surface of the photosensitive drum 1 by a predetermined distance in the direction perpendicular to the scanning direction of the laser beam L. This combination of the scanning by the laser beam L and the scrolling of the peripheral surface of the photosensitive drum 1 is continuously carried out, changing in continuity the potential level across the peripheral surface of the photosensitive drum 1 in accordance with the image formation signals. In other words, an electrostatic latent image is formed on the peripheral surface of the photosensitive drum 1.

Then, the electrostatic latent image formed on the peripheral surface of the rotating photosensitive drum 1 is continuously developed into a toner image by the developing apparatus 4. In this embodiment, the electrostatic latent image is developed in reverse into a toner image. The developing apparatus 4 in this embodiment is a developing apparatus which employs developer composed of two components, and a contact type developing method. This developing apparatus 4 will be described later in detail in Section 4.

Meanwhile, sheets of transfer medium P as the recording medium, which have been stored in a sheet feeder cassette 5, are fed out of the cassette 5 one by one by a sheet feeder roller 5*a,* into the printer A. In the printer A, the transfer medium P is fed into a transfer station T by a registration roller 5*b,* with a precontrolled timing. The transfer station T is constituted of the contact nip formed by the photosensitive drum 1, and a belt type transferring apparatus 6 as a transferring means.

In the transfer station T, the toner image on the photosensitive drum 1 side is sequentially and electrostatically transferred onto the surface of the transfer medium P by a transfer charge blade 6*d* positioned on the inward side of the loop formed by the belt of the transferring apparatus 6. This transferring apparatus 6 will be described later in detail in Section 6.

After receiving the toner image while passing through the transfer station T, the transfer medium P is gradually separated from the peripheral surface of the photosensitive drum 1, starting from the leading end, and is conveyed to a fixing apparatus 8 by a conveying apparatus 7. In the fixing apparatus 8, the toner image is thermally fixed to the transfer medium P, and then, the transfer medium P to which the toner image has been fixed, is outputted from the image forming apparatus as a copy or a print.

This embodiment is described with reference to a cleanerless image forming apparatus, that is, an image forming apparatus which does not have a cleaner for cleaning the peripheral surface of the photosensitive drum 1 after the toner image transfer, prior to the primary charging of the photosensitive drum 1. However, the present invention is also applicable to an image forming apparatus equipped with a cleaner for cleaning the residual toner after the toner image transfer, prior to the primary charging of the photosensitive drum 1.

After the toner image transfers onto the transfer medium P, a certain amount of toner remains on the peripheral surface of the photosensitive drum 1. This residual toner contains the toner particles with positive polarity and the toner particles with negative polarity. The difference in the polarity of the toner particles is caused by the electrical discharge which occurs as the toner image is transferred onto the recording medium P. The residual toner composed of the mixture of the toner particles with different polarities reaches the magnetic brush type charging device 20, that is, a contact type charging device, in which the toner particles with the positive polarity are recovered into the magnetic brush portion 23 of the magnetic brush type charging device 20, being thereby charged to the negative polarity, triboelectrically or due to some other process, and then are expelled onto the photosensitive drum 1. Then, the residual toner, all the particles of which are charged to the negative polarity at this point, is conveyed to the development station m of the developing apparatus 4, in which they are recovered into the developing apparatus 4 by the fog removing electrical field while an electrostatic latent image is developed by the developing apparatus 4. In order to improve the residual toner recovery efficiency by the magnetic brush type charging device 20, alternating voltage is superposed upon the DC voltage charged to the magnetic brush type charging device 20. In an image forming operation for continuously producing a plurality of copies, the residual toner reaches the charging device 20, which is charging the photosensitive drum 1. Thus, the residual toner carrying portion of the peripheral surface of the photosensitive drum 1 is charged, with the presence of the residual toner, and then, is exposed to the laser beam L. In other words, an electrostatic latent image is formed on the photosensitive drum 1, across the area in which the residual toner is present. Then, the latent image carrying portion of the photosensitive drum 1 enters the development station m, in which the residual toner is transferred onto the development sleeve by the fog removing electrical field while the toner is adhered to the light areas of the latent image from the development sleeve by the image developing electric field. In other words, the photosensitive drum 1 is cleaned of the residual toner at the same time and location as the latent image is developed.

As is evident from the above description, the residual toner particles with the negative polarity are not to be recovered by the magnetic brush type charging device, but are to be recorded by the developing apparatus 4. However, among the residual toner particles with the negative polarity, those with a substantially high potential level fail to be recovered by the developing apparatus 4, and are conveyed back to the transfer station T, in which they are transferred onto the transfer medium P, appearing sometimes as visible image defects. In order to prevent such a problem, the image forming apparatus in this embodiment is provided with an auxiliary charging member 10 (second contact type charging member), which is constituted of a brush formed of 6 mm long stands of electrically conductive fiber (strand density of 10,000/inch; resistance value of $5\times10^6$ ohm), and is positioned at a point which is on the upstream side of the magnetic brush type charging device 20 (first contact type charging member), in terms of the rotational direction of the photosensitive drum 1, and on the downstream side of the transfer station T, also in terms of the rotational direction of the photosensitive drum 1, (a point between magnetic brush type charging device 20 and transfer station T). The auxiliary member charging member 10 is approximately 3 mm in theoretical extension length, and forms a contact nip between itself and the peripheral surface of the photosensitive drum 1. The width of the contact nip in terms of the rotational direction of the photosensitive drum 1 is approximately 3 mm.

To this auxiliary charging member 10, or the second contact type charging member, a voltage of 500 V is applied from the electrical power source S4. The polarity of this voltage of 500 V is opposite to that of the DC voltage applied to the magnetic brush type charging device 20, or the first contact type charging member.

With the above described arrangement, the residual toner particles with a substantially large amount of negative charge are caught by this auxiliary member 10, being thereby removed of their charge, or charged to the positive polarity. Then, they are transferred back onto the photosensitive drum 1, and are recovered by the magnetic brush type charger 20 or the developing apparatus 4.

With the presence of the auxiliary charging member 10, the polarity of all the toner particles which remain on the photosensitive drum 1 after the toner image transfer is positive, and therefore, all the residual toner particles are recovered once by the charging device 20. As a result, the pattern of the image formed in the preceding image formation cycle is prevented from appearing in the images formed by the following image formation cycle.

Figure 2:
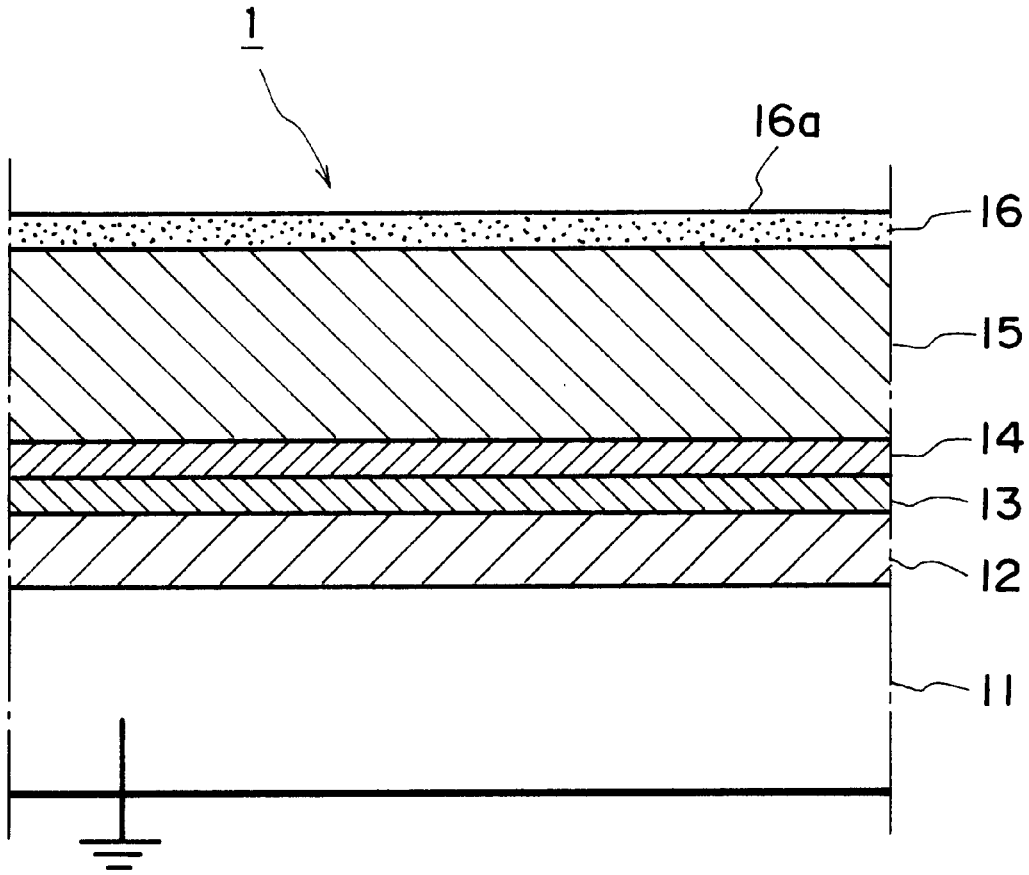
FIG. 2 is a schematic drawing of the peripheral portion of a photosensitive member, and depicts the laminar structure of the portion.

(2) Photosensitive Drum 1 (FIG. 2)

In this embodiment, an ordinary organic photosensitive member, or the like, may be employed as the photosensitive drum 1 (photosensitive member), or the image bearing member. Also, a photosensitive member based on nonorganic semiconductor such as CdS, Si, or Se may be employed. However, an organic photosensitive member, the surface layer of which is composed of material, the volumetric resistivity of which is in a range of $10^9$–$10^{14}$ ohm, an amorphous silicon based photosensitive member, and the like, are more desirable than the others, because they allow electrical charge to be directly infected, present ozone generation, and are effective to reduce electrical power consumption. Further, they are more efficiently charged than the others.

The photosensitive drum 1 in this embodiment is provided with a charge injection layer, which constitutes the top layer. It is a negatively chargeable photosensitive member. It consists of an aluminum base member in the form of a drum with a diameter of 30 mm (hereinafter, "aluminum base"), and first to fifth layers laid in this order on the aluminum base. These five layers will be described next. FIG. 2 is a vertical section of the peripheral portion of the photosensitive drum 1, and depicts the laminar structure of the portion.

First layer 12: a 20 $\mu$m thick electrically conductive undercoat layer provided to smooth out the peripheral surface of the aluminum base.

Second layer 13: a 1 $\mu$m thick positive charge injection prevention layer, which plays a role in a preventing the positive charge, which is injected from the aluminum base 11, from canceling the negative charge given to the outermost layer of the photosensitive drum 1, and electrical resistance of which has been adjusted to a medium resistance of approximately $1\times10^6$ ohm with the use of Amilan resin and methoxy-methyl-nylon.

Third layer 14: an approximately 0.3$\mu$ thick charge generation layer, which is composed of resin in which diazo group pigment is dispersed, and generates a pair of positive and negative charges as it exposed to light.

Fourth layer 15: a charge transfer layer composed of P-type semiconductor, that is, polycarbonate resin in which hydrazone has been dispersed, which prevents the negative charge, which is given to the surface layer of the photosensitive drum 1, from moving inward, while allowing the positive charge generated in the charge generation layer 14 to transfer to the surface layer of the photosensitive drum 1.

Fifth layer 16: a coated charge injection layer composed of electrically insulative binder in which electrically conductive particles 16*a*, that is, microscopic particles of $SnO_2$ with a diameter of approximately 0.03 $\mu$m, have been dispersed. More specifically, electrically insulative resin is doped, by a ratio of 70 wt. %, with antimony, which is electrically insulative filler, to reduce the resistance of the resin to give a controlled amount of electrical conductivity.

The liquid prepared as described above is coated on the fourth layer to a thickness of approximately 3.0 $\mu$m by a dipping, spraying, roller-painting, beam-painting, or the like coating methods, to form the charge injection layer.

The volumetric resistivity of the charge injection layer (surface layer) is $10^{12}$ ohm.cm. Controlling the volumetric resistivity as described above improves the efficiency with which charge is directly injected into the photosensitive drum 1, and as a result, high quality images can be produced. The photosensitive material does not need to be an organic photoconductor. It may be a-Si, which improves the durability of the photosensitive drum 1.

The volumetric resistivity of the surface layer of the photosensitive drum 1 is a value obtained in the following manner. That is, two pieces of metallic electrodes are positioned 200 $\mu$m apart, and film equivalent to the surface layer is formed between the two electrodes by flowing between the two electrodes, the liquid prepared to form the surface layer. Then, the volumetric resistivity of the film formed between the two electrodes is measured while applying a voltage of 100 V between the two electrodes, with ambient temperature and humidity set at 23° C. and 50% RH.

Figure 3:
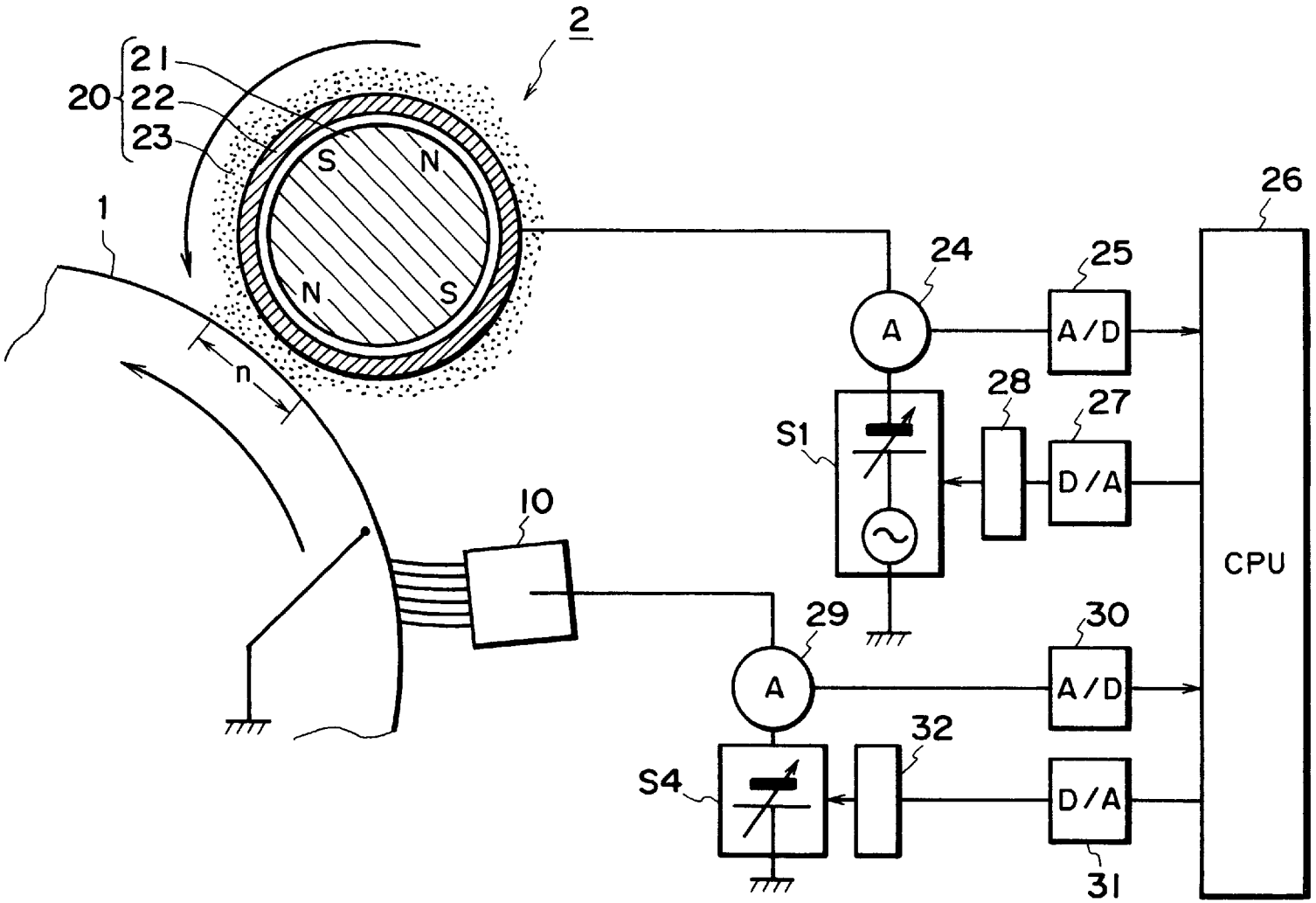
FIG. 3 is a schematic drawing which depicts the general structure of the magnetic brush type charging device portion of the image forming apparatus, and the circuit diagram of the control system for the charging device portion.

(3) Charging Apparatus 2 (FIG. 3)

The charging apparatus 2 in this embodiment is constituted of a contact type charging apparatus which employs a magnetic brush. FIG. 3 is a drawing which depicts the general structure of the charging apparatus 2. Reference character 20 designates a contact type charging device, which employs a magnetic brush, and is positioned adjacent to the photosensitive drum 1 so that its magnetic brush is placed in contact with the photosensitive drum 1.

The magnetic brush based charging device 20 in this embodiment is of a rotative sleeve type. In other words, it consists of a magnetic roller 21, a sleeve 22, a magnetic brush 23, and the like. The magnetic roller 21 is nonrotatively supported. The sleeve 22 is nonmagnetic and is 16 mm in external diameter. It is rotatively fitted around the magnetic roller 21 (nonmagnetic, electrically conductive sleeve which serves as electrode). The magnetic brush 23 is formed of electrically conductive magnetic particles (magnetic carrier for charging) held on the peripheral surface of the sleeve 22 by the magnetic force of the magnetic roller 21 within the sleeve 22.

The magnetic brush based charging device 20 is positioned adjacent to the photosensitive drum 1, so that their peripheral surfaces become virtually parallel with each other, and the magnetic brush 23 remains in contact with the peripheral surface of the photosensitive drum 1, and the width, in terms of the rotational direction of the photosensitive drum 1, of the contact nip n (charging station) formed by the magnetic brush 23 against the photosensitive drum 1 becomes approximately 5 mm.

As for the desirable magnetic particles for forming the magnetic brush 23, they are such magnetic particles that are 10–100 $\mu$m in average particle diameter, 20–250 emu/cm$^3$ in saturation magnetization and $1\times10^2$–$1\times10^{10}$ ohm.cm in electrical resistance. Further, in consideration of the fact that the photosensitive drum 1 may have pin holes, that is, defects in terms of electrical insulation, it is desired to employ magnetic particles, the electrical resistance of which is no less than $1\times10^6$ ohm.cm. However, in order to improve the charging performance of the charging device 20, it is desired that the electrical resistance of the magnetic particles is as small as possible. Thus, in this embodiment, magnetic particles which are 25 $\mu$m in average particle diameter, are 200 in emu/cm$^3$, and $5\times10^6$ ohm.cm are employed.

The resistance value of the magnetic particles is obtained in the following manner. That is, 2 grams of magnetic particles are placed in a metallic cell with a bottom size of 228 mm$^2$. Then, the electrical resistance of the magnetic particles in the cell is measured while applying a weight of 6.6 kg/cm$^2$ and a voltage of 100 V.

The average particle diameter of the magnetic particles is represented by the maximum horizontal cord length, which is measured with the use of a microscope. More specifically, no fewer than 300 magnetic particles are picked out at random, and their horizontal cord lengths are actually measured with the use of a microscope. Then, the mathematical average of their measurements is obtained.

As for the apparatus to be used to measure the magnetic characteristics of the magnetic particles, an automatic magnetization B-H characteristics recording apparatus BHH-50 (product of Riken Electronic Co., Ltd.) may be used. For the measurement, the magnetic particles are filled in a cylindrical container which is 6.5 mm in internal diameter, and 10 mm in height, and is packed with a weight of approximately 2 kg so that the particles do not move within the container. Then, the saturation magnetization of the particles is calculated from the B-H curve of the particles in the container.

There are various magnetic particles which may be used as the magnetic particles for the magnetic brush. For example, there are particles formed of resin in which magnetic particles are dispersed as a magnetic substance, and carbon black is dispersed to adjust electrical resistance of the resin, that is, to make the resin electrically conductive, particles of pure magnetite such as ferrite, the surfaces of which have been oxidized or reduced to adjust electrical resistance, particles of pure magnetite such as ferrite, the surfaces of which have been coated with resin to adjust electrical resistance, and the like. In this embodiment, ferrite particles, the surfaces of which have been oxidized or reduced to adjust their electrical resistance, are used.

The nonmagnetic sleeve 22 of the magnetic brush type charging device 20 is rotated in the counterclockwise direction indicated by an arrow mark, so that its rotational direction in the charging station n becomes opposite (counter) to that of the photosensitive drum 1. It is rotated at a peripheral velocity of 150 mm/sec, whereas the photosensitive drum 1 is rotated at a velocity of 100 mm/sec.

To the nonmagnetic sleeve 22, a predetermined charge bias is applied from a charge bias application electrical power source S1.

In this embodiment, in order to charge the photosensitive drum 1 for image formation, an oscillating compound voltage composed of AC voltage and DC voltage is applied to the nonmagnetic sleeve 22. The level of the DC voltage is kept constant at −550 V, and the AC voltage has a waveform roughly like a sine wave, and a frequency of 1 kHz. The peak-to-peak voltage is 700 V.

As the nonmagnetic sleeve 22 is rotated, the magnetic brush 23 is rotated in the same direction, rubbing the peripheral surface of the photosensitive drum 1 in the charging station n. In the charging station, as the magnetic brush 23 rubs the peripheral surface of the photosensitive drum 1, an electrical charge is given to the surface layer of the photosensitive drum 1 from the magnetic brush 23, that is, the magnetic particles agglomerated in the shape of the magnetic brush 23. In other words, the surface layer of the photosensitive drum 1 is uniformly charged to a predetermined polarity and potential level through the direct contact between the photosensitive drum 1 and the charging device.

As described above, the photosensitive drum 1 in this embodiment is provided with the charge injection layer 16 as its surface layer. Therefore, it can be injected with electrical charge. In other words, as the predetermined charge bias voltage is applied to the nonmagnetic sleeve 22, electrical charge is given to the surface layer of the photosensitive drum 1 from the magnetic particles agglomerated in the form of the brush 23. As a result, the peripheral surface of the photosensitive drum 1 is charged to a potential level equivalent to the charge bias voltage. There is a tendency that the higher the rotational speed of the nonmagnetic sleeve 22, the better the photosensitive drum 1 is charged in terms of uniformity.

Reference characters 26 through 28 designate the sections of the bias control system which changes the value of the voltage applied to the magnetic brush type charging device 20, or the contact type charging member. These sections will be described later in detail in Section 6.

Figure 4:
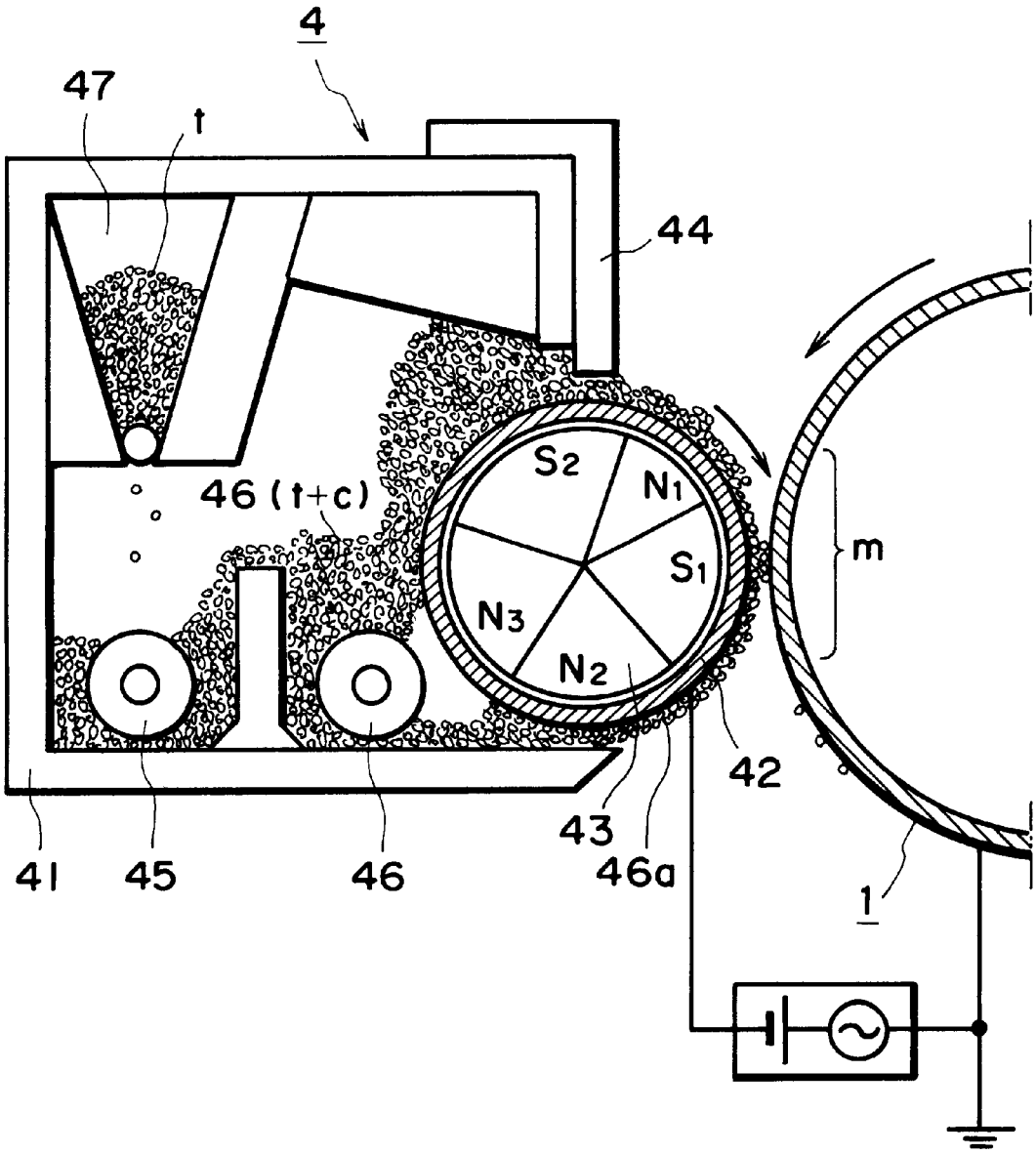
FIG. 4 is a vertical section of the developing apparatus portion of the image forming apparatus, and depicts the general structure of the developing apparatus portion.

(4) Developing Apparatus 4 (FIG. 4)

Methods for developing an electrostatic latent image with the use of toner, which are compatible with the present invention, may generally be divided into the following four major groups a through d.

a. An electrostatic latent image is developed with nonmagnetic toner coated on the development sleeve with the use of a blade or the like, or magnetic toner magnetically coated on the sleeve, while a gap is maintained between the coated surface of the toner and the photosensitive drum 1 (noncontact development based on single component developer).

b. An electrostatic latent image is developed with nonmagnetic toner, or magnetic toner, coated in the same manner as in the method a, while the coated surface of the toner is kept in contact with the photosensitive drum 1 (single component developer based contact development).

c. An electrostatic latent image is developed with developer, which is composed by mixing toner with magnetic carrier, and is held on the peripheral surface of the development sleeve by the magnetic force, while the surface of the developer layer magnetically carried on the development sleeve is kept in contact with the photosensitive drum 1 (contact development based on two component developer).

d. An electrostatic latent image is developed with the same developer carried in the same manner as the developer in the method c, while a gap is maintained between the surface of the developer layer and the photosensitive drum 1 (noncontact development based on two component developer).

Among the above listed four developing methods, the method c, or the contact type developing method which uses two component developer, has been widely used in consideration of image quality and stability.

FIG. 4 is a vertical section of the developing apparatus 4 in this embodiment, and its adjacencies. It depicts the general structure of the developing apparatus 4. The developing apparatus in this embodiment is constituted of a contact type developing apparatus that uses a mixture of nonmagnetic toner and magnetic carrier, as developer. In an image forming operation, the developing apparatus 4 holds this mixture, or the developer, in a layer (magnetic brush layer) on the peripheral surface of a developer carrying member, by magnetic force, and conveys it to the development station, in which it places the mixture in contact with the peripheral surface of the photosensitive drum 1 to develop an electrostatic latent image into a toner image.

Reference character 41 designates a developer container; 42, a development sleeve as a developer carrier; 43, a magnetic roller as a means for providing a magnetic field, which is statically positioned within the development sleeve 42; 44, a developer layer thickness regulating blade 45 for forming a thin layer of developer on the peripheral surface of the development sleeve 42; 45, a screw for stirring/conveying the developer; and a referential character 46 designates the developer, which is composed by mixing two components, that is, nonmagnetic toner particles t and magnetic particles c as carrier particles, and is held in the developer container 41.

The development sleeve 42 is positioned so that its closest distance (gap) to the peripheral surface of the photosensitive drum remains approximately 500 $\mu$m at least during the development period. In other words, it is structured so that the thin layer 46*a* of the magnetic developer, or a brush formed of the magnetic developer, which is carried on the peripheral surface of the development sleeve 42, is kept in contact with the peripheral surface of the photosensitive drum 1. The development area (station) is constituted of the nip m formed by the contact between this thin layer 46*a* of the magnetic developer, and the peripheral surface of the photosensitive drum 1.

The development sleeve 42 is rotated about the magnetic roller 43 statically positioned within the development sleeve 42, at a predetermined speed in the clockwise direction indicated by an arrow mark. As it is rotated, a thin layer of the developer 46, or the magnetic brush, is formed on the peripheral surface of the development sleeve 42 by the magnetic force of the magnetic roller 43, in the developer container 41. The thus formed magnetic brush, or the thin layer of the developer 46, is carried out of the developer container 41 which being regulated in its thickness, and therefore, becoming a thin and even layer of the developer, and then is carried to the development station, in which it comes in contact with the peripheral surface of the photosensitive drum 1. Thereafter, it is carried back to the developer container 41 by the continuous rotation of the sleeve 42.

More specifically, as the development sleeve 42 is rotated, the developer 46 is first picked up onto the peripheral surface of the developer sleeve 41 by a magnetic pole N3 of the magnetic roller 43. Then, between the location correspondent to that of a magnetic pole S1 and the location correspondent to that of a magnetic pole N1, the layer of the developer 46 is regulated in thickness by the regulator blade 44 positioned perpendicular to the peripheral surface of the photosensitive drum 1, becoming the thin, even layer 46*a* of the developer. Then, at the location correspondent to that of a magnetic pole S1, or the primary development pole, in the development station, the magnetic developer particles agglomerate in the form of a broom tip. This agglomeration of the developer particles in the form of a broom tip develops the electrostatic latent image on the photosensitive drum 1 into a toner image. Thereafter, the developer on the development sleeve 42 is placed back into the development container 41 by the repulsive magnetic field formed by magnetic poles N3 and N2.

Between the development sleeve 42 and the electrically conductive base, in the form of a drum, of the photosensitive drum 1, development bias, that is, compound voltage composed of DC voltage and AC voltage, is applied from a development bias application power source S2.

In this embodiment, the DC voltage applied for developing the latent image is −400 V, and the AC voltage applied for developing the latent image is 1500 V in peak-to-peak voltage Vpp, and 3000 Hz in frequency. With the application of the development bias in the development station, the toner particles t in the thin layer 46*a*, or the brush, of the magnetic developer, on the development sleeve 42, adhere to the peripheral surface of the photosensitive drum 1, in a manner to reflect the electrostatic latent image. In other words, the electrostatic latent image is developed into a toner image.

Generally speaking, in the case of a developing method which employs developer composed of two components, application of alternating voltage increases development efficiency, improving thereby image quality, although it is risky in that it has a tendency to make an image foggy. Therefore, it is a common practice to provide a certain amount of difference between the level of the DC voltage applied to the developing apparatus 4 and the level of the potential of the electrical charge given to the surface layer of the photosensitive drum 1 so that a foggy image is not produced.

This difference in potential level for presenting the fog generation is called "fog removal potential (Vback)". With the presence of this potential level difference, toner is prevented from adhering to the areas of the peripheral surface of the photosensitive drum 1, which are supposed to be developer free, during the image development period.

The toner density (ratio of toner to carrier) of the developer 46 within the developer container gradually reduces as the toner is consumed for developing electrostatic latent images. It is detected by an unillustrated detecting means. As it reduces to a predetermined lowest permissible density, the toner t is supplied to the developer 46 in the developer container 41 from a toner supplying portion 47, so that the toner density of the developer 46 in the developer container 41 always remains within a predetermined permissible range.

The developer 46 used in this embodiment is composed by mixing the following two components at a ratio of 6:94.

Toner particles t: mixture of negatively chargeable toner particles with an average particle diameter of 6 $\mu$m, and titanium oxide particles with the average particle diameter of 20 nm (1% in weight).

Carrier c: magnetic carrier with a saturation magnetization of 205 emu/cm$^3$, and an average particle diameter of 35 $\mu$m.

The volumetric average particle diameter is measured by the following method.

As for the measuring apparatus, a Coulter Counter TA-11 (Coulter Co., Ltd.) is used, to which an interface (Nikkaki Co., Ltd.) which outputs numerical average distribution and volumetric average distribution, and a personal computer CX-i (Canon Inc.), are connected. As for the electrolyte, 1% water solution of first class sodium chloride is prepared.

To 100–150 ml of this water solution of sodium chloride, 0.1–5 ml of surfactant (alkylbenzene sulfonate is desirable) is added as dispersant, and then, 0.5–50 mg of test material is added.

The electrolyte in which the test material has been suspended is treated with an ultrasonic disperser for approximately 1–3 minutes. Then, the particle size distribution of the particles, the sizes of which are in a range of 2–40 $\mu$m, is measured with the aforementioned Coulter counter TA-II fitted with a 100 $\mu$m aperture, and the volumetric distribution is obtained. From the thus obtained volumetric distribution, the volumetric average particle diameter of the test material is obtained.

(5) Transferring Apparatus 6 (FIG. 1)

As described previously, the transferring apparatus in this embodiment is of a transfer belt type. Reference character 6*a* designates an endless transfer belt, which is stretched between a driver roller 6*b* and a follower roller 6*c,* and is rotatively driven at substantially the same velocity as the peripheral velocity of the photosensitive drum 1 in such a direction that it moves in the same direction as the peripheral surface of the photosensitive drum 1 where they meet with each other. Reference character 6*d* designates a transfer charge blade, which is positioned within the loop of the transfer belt 6*a*. The transfer charge blade 6*d* causes the transfer belt and the photosensitive drum 1 to form a transfer nip T by pressing the transfer belt 6*a* upon the photosensitive drum 1, at the top side of the belt loop. As transfer bias is applied to the transfer charger blade 6*d,* the transfer medium P is charged to the polarity opposite to the polarity of the toner charge, from the bottom side. As a result, a toner image on the photosensitive drum 1 is electrostatically transferred onto the top side of the transfer medium, starting at the leading edge of the transfer medium P, while the transfer medium P is passed through the transfer station T.

In this embodiment, the belt 6*a* is formed of 75 $\mu$m thick polyimide film.

The material for the belt 6*a* does not need to be limited to polyimide resin. Plastic material such as polyethyleneterephthalate resin, polyfluorovinylidene resins, polyethylenenaphthalate resin, polyether ether keton resin polyethersulfon resin, and polyurethane resin, or rubber such as fluorinated rubber and silicone rubber, can be employed with desirable results. Also, the belt thickness does not need to be limited to 75 $\mu$m. It does not matter as long as it is in a range of 25–2000 $\mu$m, preferably, 50–150 $\mu$m.

The transfer charge blade 6*d* is $1\times10^5$–$1\times10^7$ ohm in resistance, 2 mm in thickness, and 306 mm in length. In order to transfer a toner image, bias with positive polarity is applied to this transfer charge blade 6*d,* while controlling the power source so that the electrical current through the blade is maintained at 15 $\mu$A.

(6) Controlling of Bias Applied to Contact Type Charging Member

As described before, in the case of a contact type charging apparatus, the contact type charging member is placed in contact with the object to be charged, and therefore, it is liable to become contaminated by the contaminants, or foreign substances, which the contact type charging member picks up from the object to be charged. If the contamination progresses beyond a permissible level, the contact type charging member loses its charging performance. For example, it may fail to charge the object to be charged to a desired potential level, or may nonuniformly charge the object to be charged.

Generally speaking, even if an image forming apparatus Which employs a contact type charging apparatus is equipped with a cleaning apparatus dedicated to removing the toner which remains on the image bearing member after image transfer, it is impossible for the cleaning apparatus to completely remove the toner particles, the external additive such as silica contained in the developer, and the like, that is, the contaminants, from the peripheral surface of the photosensitive drum 1. In other words, a small amount of the contaminants passes by the cleaning apparatus, and reaches the contact type charging member by the rotation of the image bearing member, contaminating the contact type charging member by adhering to, or mixing into, the contact type charging member. This process continues, gradually increasing the contamination of the contact type charging member, as the image formation cycle is repeated.

Figure 5:
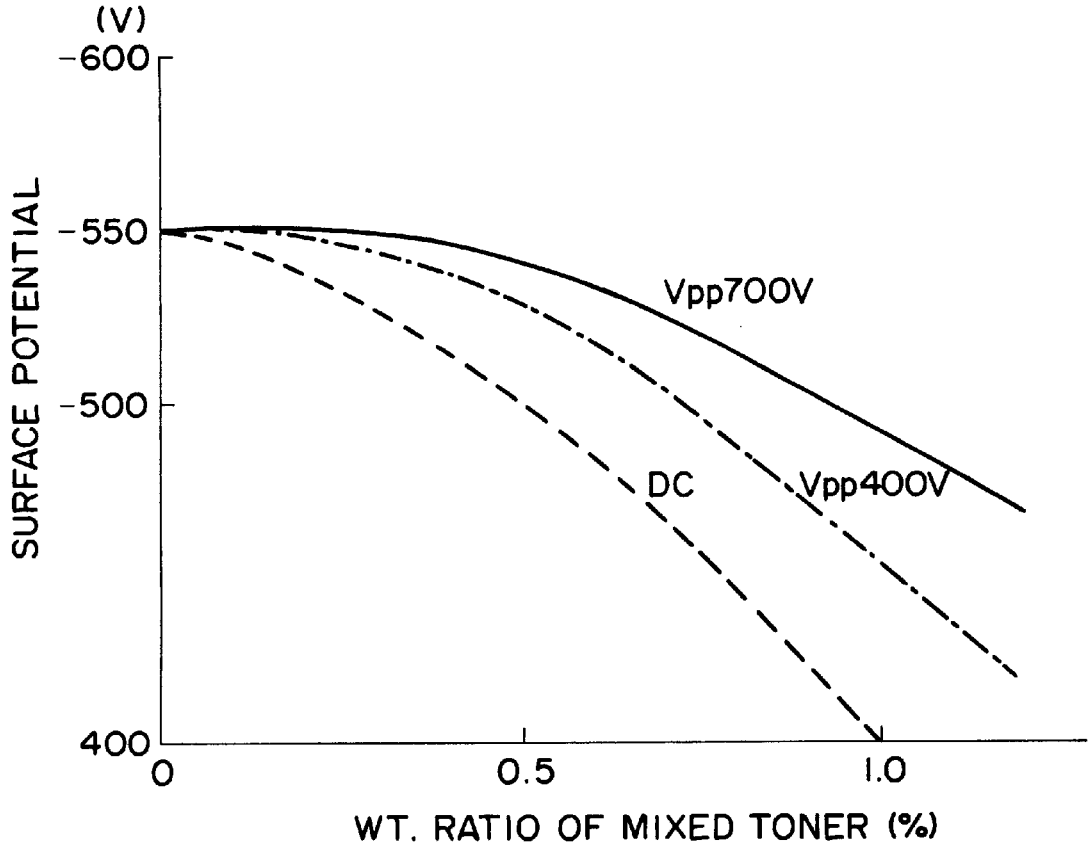
FIG. 5 is a graph which depicts the relationships which occur between the amount of the toner which mixes into the magnetic brush of the magnetic brush type charging device, and the potential level to which the peripheral surface of the photosensitive member is charged, when three different voltages are applied to the magnetic brush type charging device.

FIG. 5 is a graph which depicts the relationship between the potential level of the peripheral surface of photosensitive drum 1, and the weight ratio of the toner particles, which had mixed into the magnetic particles of the magnetic brush type charging device 20 as the contact type charging member, relative to the magnetic particles of the magnetic brush. The potential level is plotted on the axis of ordinates, and the weight ratio of the toner relative to the magnetic particles is plotted on the axis of abscissa axis of ordinates. The solid line represents the relationship when a compound voltage composed of a DC voltage of −550 V and an AC voltage with a peak-to-peak voltage Vpp of 700 V is applied; the single dot chain line represents the relationship when a compound voltage composed of a DC voltage of −550 V and an AC voltage with a peak-to-peak voltage of 400 V is applied; and the broken line represents the relationship when only a DC voltage of −550 V is applied. As is evident from the graph, the greater the peak-to-peak voltage Vpp of the AC voltage, the greater the tolerable weight ratio of the toner relative to the magnetic particles. As for the tolerable amount of drop in the potential level of the charge at the peripheral surface of the photosensitive drum 1, it varies depending on developer characteristics, ambience, the choice in image processing method, and the like. However, there is a specific amount of drop in potential level at the peripheral surface of the photosensitive drum 1, beyond which the toner adheres to the peripheral surface of the photosensitive drum 1, even to the areas where it not supposed to adhere, that is, the areas correspondent to the white areas of the original, in other words, the so-called fog occurs. In this embodiment, this amount was 60 V.

Figure 6:
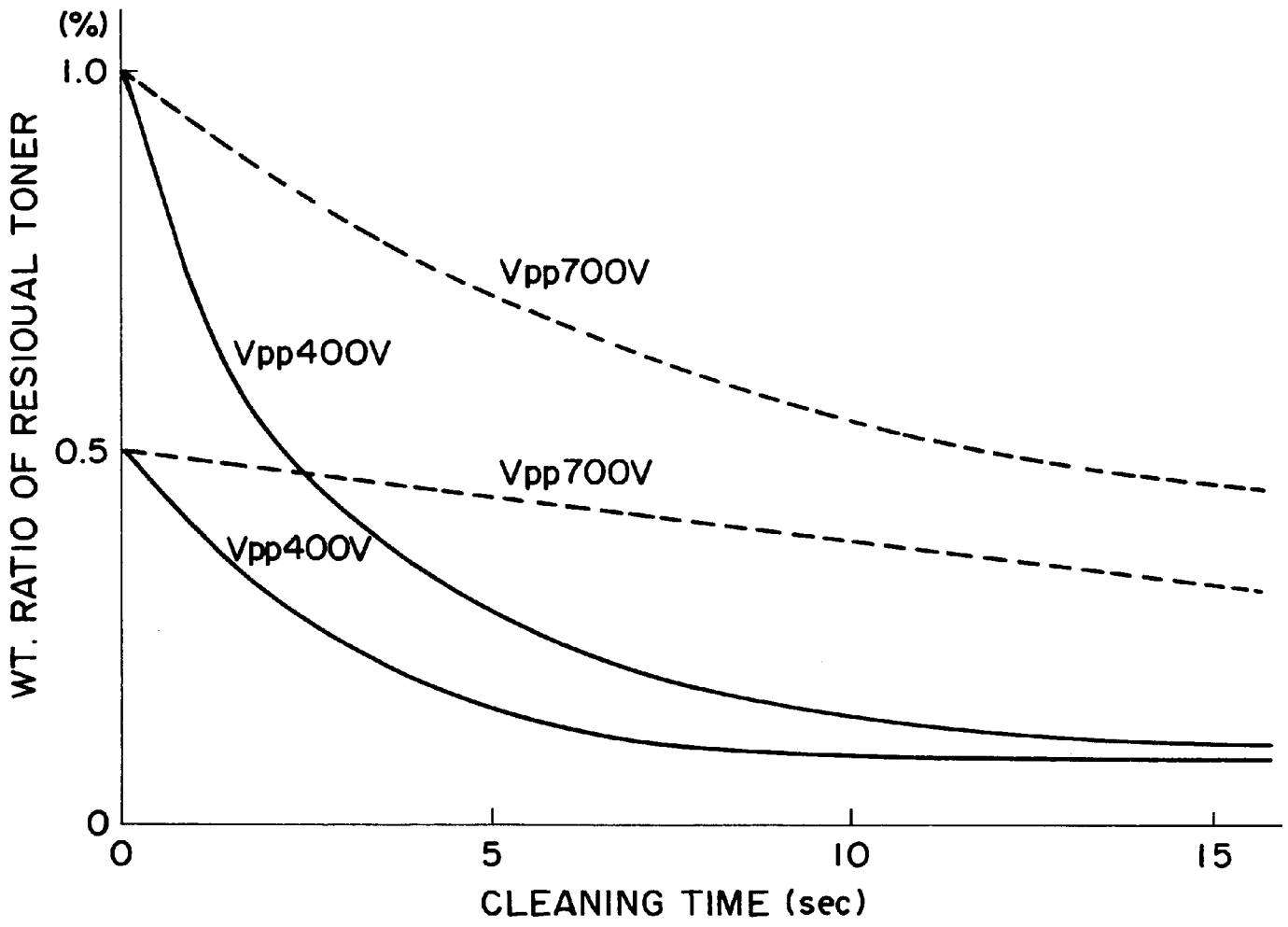
FIG. 6 is a graph which depicts the change in the amounts of the toner which mix into the magnetic brush of the magnetic brush type charging device, which occurs when three different voltages are applied to the magnetic brush type charging device.

FIG. 6 is a graph which depicts the relationship between the weight ratios (0.5 wt. % and 1.0 wt. %) of the toner particles, which remained mixed with the magnetic particles, relative to the magnetic particles, and the cleaning time. In the graph, solid broken lines represent the relationship when the peak-to-peak voltage Vpp of the AC bias applied to the magnetic brush type charging device was 400 V and 700 V, respectively.

After a process of charging the photosensitive drum 1 for image formation is stopped (for example, during the post-image formation rotation of the photosensitive drum 1), and the portion of the peripheral surface of the photosensitive drum 1, which is correspondent to the trailing end of the image, passes the position of the charging device, the peak-to-peak voltage Vpp of the voltage applied to the charging device is reduced to 400 V in order to cause the magnetic brush type charging device to expel the toner from the magnetic brush onto the photosensitive drum 1. This is because the efficiency, with which the amount of the toner which remains in the magnetic brush type charging device is reduced, can be increased by reducing the level of the peak-to-peak voltage Vpp of the AC voltage applied to the charging device, compared to the level when the photosensitive drum 1 is charged for image formation (when the photosensitive drum 1 is charged across the areas correspondent to the image).

The "area correspondent to the image" means the portion of the peripheral surface of the photosensitive drum 1, on which image formation is possible in accordance with optional image formation data (portion which, without exposure, produce an image area solidly covered with toner).

The reason why the toner in the charging device can be expelled with higher efficiency by reducing the peak-to-peak voltage Vpp is as follows. In the charging device, the polarity of the toner becomes the same as that of the toner which is ready to develop a latent image. Also, as described with reference to FIG. 5, the smaller the peak-to-peak voltage Vpp of the AC voltage applied to the charging device, the greater the potential level to which the photosensitive drum 1 is charged, and therefore, the stronger the electric field which expels the toner from the magnetic brush onto the photosensitive drum 1. Further, the greater the amount of the toner which had mixed with the magnetic particles of the magnetic brush, the greater the amount by which the toner which had mixed with the magnetic particles changes. It is possible to reduce the peak-to-peak voltage Vpp of the AC voltage applied to the charging device to 0 V, in other words, to apply only the DC voltage to the charging device, during the post-image formation rotation period, even in the case of this embodiment. However, the greater the amount of the toner which had mixed with the magnetic particles of the magnetic brush, the lower the potential level to which the photosensitive drum 1 is charged, and therefore, the more likely is the photosensitive drum 1 to be charged to a potential level below which fog is created in the development station. Therefore, it is desired that the DC voltage applied to the magnetic brush type charging device, or the DC voltage applied to the developing apparatus, is also changed. Thus, in this embodiment, the peak-to-peak voltage Vpp of the AC voltage applied to the magnetic brush type charging device during the post-image formation rotation is set at 400 V.

Figure 7:
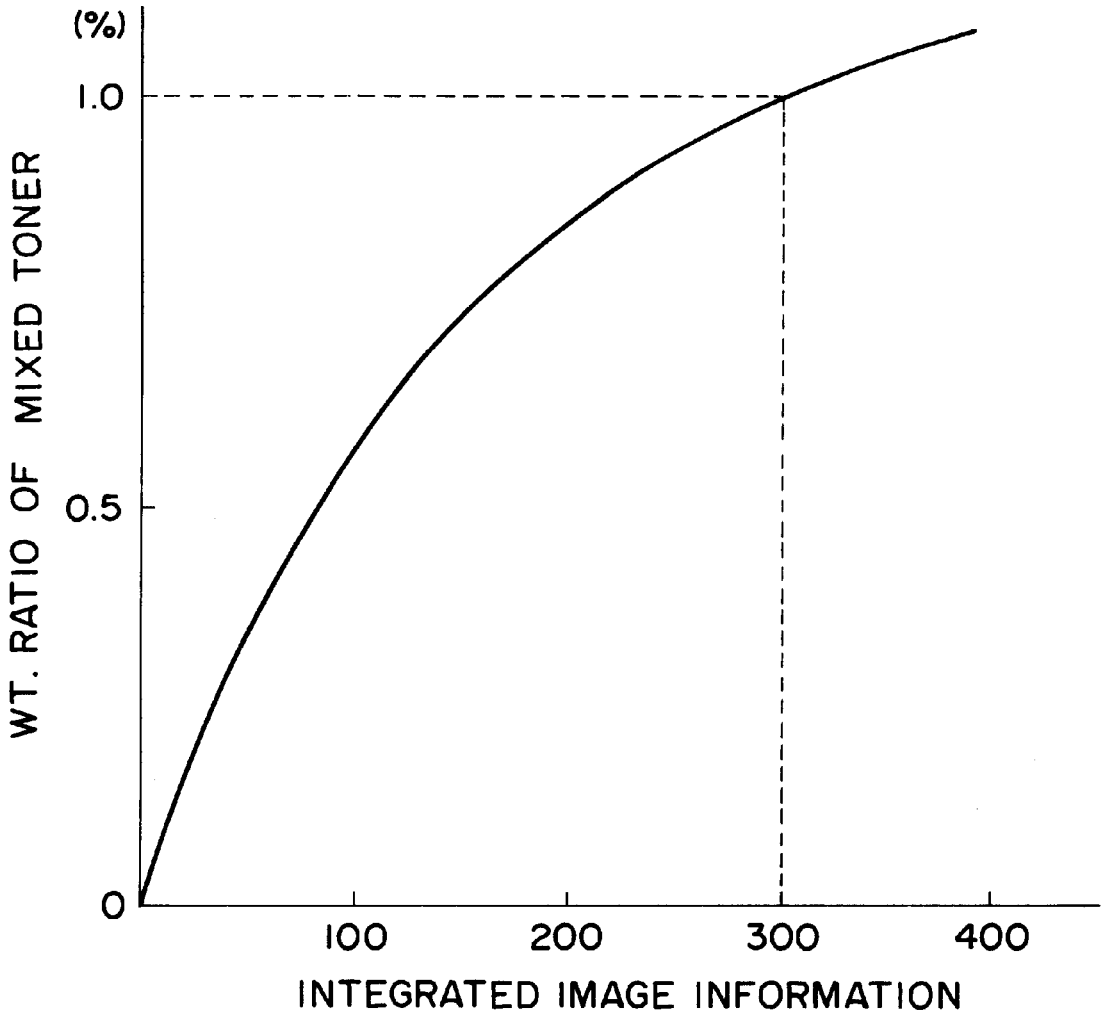
FIG. 7 is a graph which depicts the relationship between the cumulative amount of image formation data and the amount of the toner which mixed into the magnetic type charging device.
Figure 8:
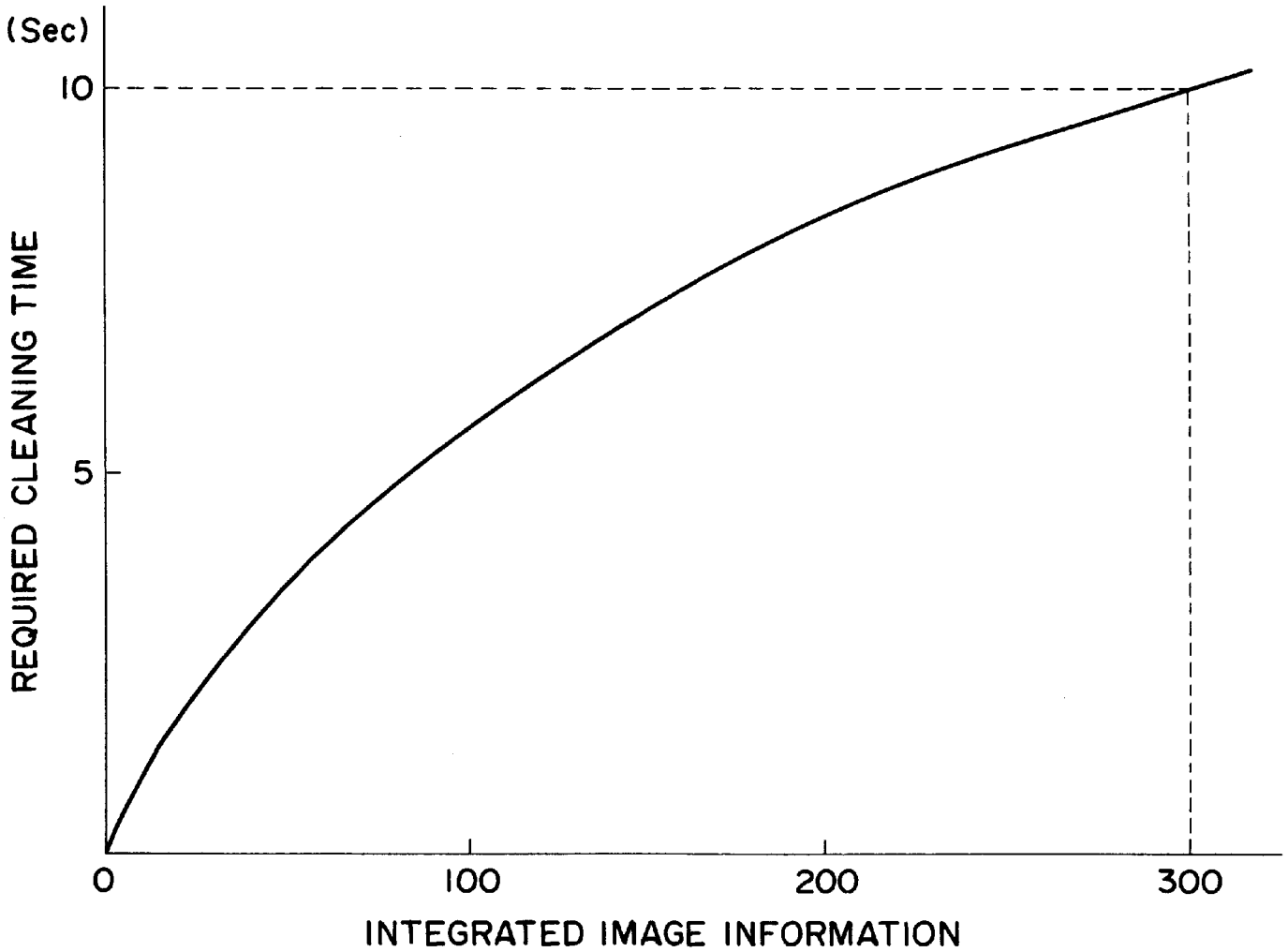
FIG. 8 is a graph which depicts the relationship between the amount of the toner which mixed into the magnetic brush type charging device, and the amount of time necessary to clean the charging device.

FIG. 7 is a graph which depicts the relationship between the weight ratio of the toner, which mixed with the magnetic particles of the magnetic brush type charging device, relative to the magnetic particles, and the cumulative amount of the image formation data, which corresponds with the toner consumption of an image forming apparatus. The former is plotted on the axis of ordinates, and the latter is plotted on the axis of abscissas. It should be noted here that FIG. 7 represents a case in which the above described cleaning sequence which involves the magnetic brush type charging device is not practiced. As for the unit by which the cumulative amount of the image formation data is measured, a specific amount of image formation data large enough to exactly cover the entire area of an A4 size sheet with the maximum density is defined as a single unit of image formation data. As is evident from FIG. 7, there is a certain correlation between the amount of toner which is mixed into the magnetic brush type charging device, and the cumulative amount of image formation data. When the peak-to-peak voltage Vpp of the AC voltage applied to the magnetic brush type charging device was 700 V, the maximum amount of toner, in terms of weight ratio, which is allowed to mix with the magnetic particles of the magnetic brush type charging device while keeping the potential level, to which the photosensitive drum 1 was charged, within a permissible range was 1% (weight ratio of toner at which potential level to which photosensitive drum 1 was charged was −490 V, which is lower by 60 V compared to −550 V to which photosensitive drum 1 was charged when no toner had mixed with magnetic particles) as shown in FIG. 5. Further, it is evident from FIG. 7 that the maximum cumulative amount of image formation data without allowing toner to mix with the magnetic particles of the magnetic brush type charging device by more than 1% in weight is 300. Further, it is evident from FIGS. 7 and 8 that if the amount of the toner which is mixed with the magnetic particles is 1% in weight, the amount of the toner in the magnetic brush can be sufficiently reduced in 10 seconds of cleaning time. FIG. 8 depicts the relationship between the cumulative amount of image formation data and the cleaning time, in seconds, necessary to sufficiently reduce the amount of the toner, which had mixed with the magnetic particles.

The cumulative amount of image formation data may be obtained in the following manner: adding up the digital signals outputted from the scanner B, before the signals are transferred to the printer, calculating the ratio of the cumulative amount of image formation data relative to the specific amount of image formation data large enough to exactly cover the entire area of an A4 size sheet with the maximum density, and transferring the calculated ratio to an unillustrated CPU of the printer, which adds up the amount of the image formation data. If the printer is provided with a means for storing image formation data, and the signals processed for image formation are temporarily stored in this image formation data storing means, the counting and adding of Image formation data may be carried out by the CPU on the printer side. In the case of a color printer, the digital signals from each of the images of primary colors obtained by separating the original image are added up, and the cumulative amount of image formation data is added up for each of the color development stations.

As for the means for adding up the amount of toner consumption, instead of using the above described method which depends on the digital signals from the scanner B, one of the following methods may be employed: a method which optically detects the amount of the toner within the developer container; a method which determines the amount of the toner in the developer container by detecting the change in magnetic force in the container; a method which detects a toner patch formed on the peripheral surface of the photosensitive drum 1, and determines the cumulative amount of toner consumption from the results of the detection; and a method which determines the cumulative amount of toner consumption based on the toner supply signals which cause the developer container to be supplied with a fresh supply of toner based on the signals outputted by one of the preceding methods.

In order to prevent the toner from being adhered to the low potential level portion of the peripheral surface of the photosensitive drum 1 during the period in which an image is not to be formed, the timing with which the charging of the photosensitive drum 1 is stopped (voltage applied to photosensitive drum 1 is stopped) is desired to be set so that it is assured that the peripheral surface of the photosensitive drum 1 is provided with electrical charge with the adequate potential level until the development process in the development station is that the voltage application to the charging device is stopped before a transfer medium on which an image has been formed is discharged from the image forming apparatus. In this embodiment, the charging of the photosensitive drum 1 can be stopped approximately 1 second before the transfer medium is discharged from the image forming apparatus. Thus, even if the photosensitive drum 1 is rotated approximately 1 second to clean the magnetic brush type charging device, before ending the printer operation, it does not affect the overall length of printing time, in a practical sense. Therefore, the time for cleaning the charging device is set to be 1 second for the job length of 1 to 10 prints, 2 seconds for 11 to 50 prints, 3 seconds for 51 to 100 prints, then, an additional 1 second per 50 prints up to 401 prints. Then, beyond 401 prints it is set to be 10 seconds.

The above print count means the number of copies continuously printed after a single external image formation start signal is inputted into the image forming apparatus. The job length means the length of the time spent for the actual printing operation. Thus, the longer the time allowed for cleaning becomes, the longer the waiting time between two jobs becomes. In this embodiment, however, an arrangement is made so that cleaning time is increased as the number of continuously produced prints increases. Therefore, cleaning time per copy does not increase as much.

As described above, the length of cleaning time is determined based on job length (number of continuously printed copies). The length of necessary cleaning time shown in FIG. 8 is calculated based on cumulative image formation data per job. If the length of time necessary for cleaning the charging device is within the length set for cleaning, the operation for cleaning the charging device is carried out only for the length of time necessary to clean the charging device, after the charging of the photosensitive drum 1 for image formation is stopped. However, if the length of time necessary for cleaning the charging device exceeds the length of time set for cleaning, the cleaning operation is carried out for the duration of the length of time set for cleaning, and the difference between the necessary and set lengths of time for cleaning is carried over to be added to the length of time necessary to clean the charging device after the following job, or the amount of the cumulative image formation data calculated for the following job is increased by the amount equivalent to the length of time for cleaning, which is carried over from the preceding job.

However, if the cumulative amount of image formation data for each copy within a single job exceeds 300 units, the cleaning operation for the charging device is carried out for 10 seconds before an image is formed on the following transfer medium, in spite of the fact that copies are supposed to be continuously made. This procedure prevents the photosensitive drum 1 from being charged to a potential level lower than the level below which fog is generated. In this case, the memory in which the cumulative amount of image formation data is stored is reset to zero each time the cleaning operation is carried out during a single job sequence.

Further, if the cumulative amount of image formation data exceeds 300 units during a single job, the cleaning operation may be carried out for a predetermined substantial length of time after the end of the job, regardless of the number of copies continuously printed in the job, so that the toner in the charging device is reduced by a substantial amount.

In the above, a description is made of the sequence for cleaning the magnetic brush type charging device carried out after the printing cycle for the last copy of a job (after the charging of photosensitive drum 1 for image formation is stopped). However, an arrangement may be made so that the cleaning sequence associated with the preceding job is carried out immediately before the following continuous printing job is started (immediately before the charging of the photosensitive drum 1 for image formation is started, that is, immediately before the leading end of the portion of the peripheral surface of photosensitive drum 1, on which an image will be formed, passes the charging point), or so that the cleaning operation is carried out while the charging device faces the portion of the photosensitive drum 1, which corresponds to the interval between one of the transfer medium and the next (portion of the photosensitive drum 1, on which an image will be formed).

FIG. 1 illustrates an example of an image forming apparatus in which an image formed on the photosensitive drum 1 is directly transferred onto the transfer medium. However, an image formed on the photosensitive drum 1 may be first transferred onto an intermediary transferring member, and then, may be transferred from the intermediary transferring member to the transfer medium.

Next, an embodiment, in which the cleaning sequence is carried out in each of the four image formation stations of a full-color image forming apparatus, will be described.

Figure 9:
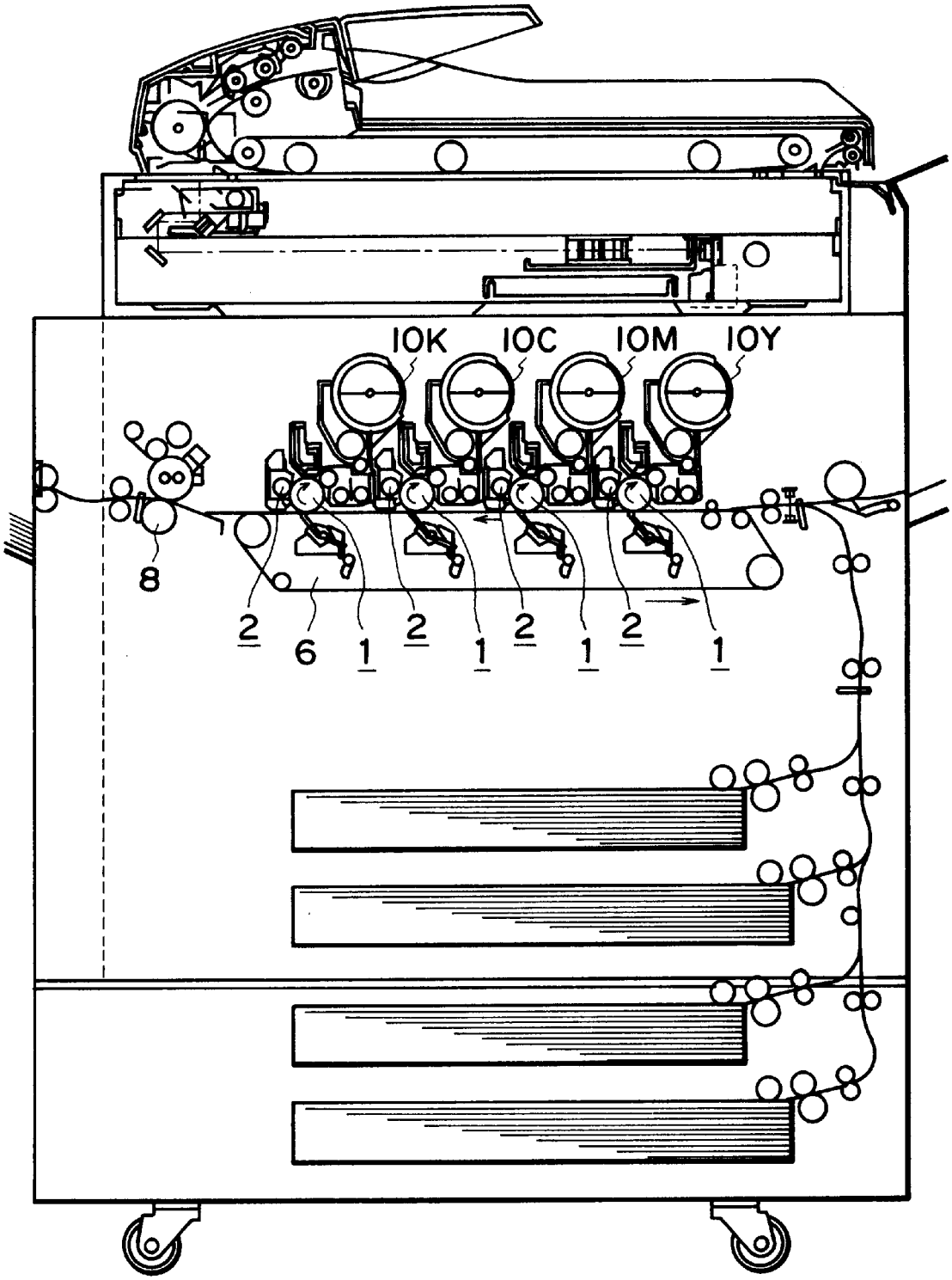
FIG. 9 is a vertical section of a full-color image forming apparatus in an embodiment of the present invention, and depicts the general structure of the apparatus.

FIG. 9 is a vertical section of a full-color image forming apparatus in this embodiment, and depicts the general structure of the apparatus. Reference characters 10Y, 10M, 10C and 10K designate stations for forming yellow, magenta, cyan and black images, respectively. Each station is equipped with its own photosensitive member and processing devices for forming images on the photosensitive member, and carries out the same image forming operation as that carried out in the image forming apparatus illustrated in FIG. 1. The toner image formed on the photosensitive member in each station is transferred in layers onto a transfer medium carried by a transfer belt. When a full-color image is formed, the plurality of stations are sequentially activated to carry out their own image forming operations, with an interval proportional to the physical distance between adjacent two stations. Thus, the length of time from a point in time at which one station is triggered for an image forming operation, to a point in time at which the next station is triggered for an image formation, or the length of time from a point in time at which a full-color image forming operation ends, to a point in time at which the discharging of the transfer medium ends, is proportional to the distance between the adjacent two stations. In this embodiment, the time it takes for a transfer medium to move the distance between the adjacent two stations is 1 second. The first station, or the yellow image station 10Y, is triggered for image formation 1 second after the full-color image forming apparatus is triggered for image formation in full-color, and the discharging of the transfer medium ends 1 second after the ending of the image formation in the fourth station, or the black image station 10K. Thus, 5 seconds, inclusive of 1 second immediately before the starting of actual full-color image formation and 1 second immediately after the ending of actual full-color image formation, is available as idle time, in terms of image formation in a pure sense, to each station.

Figure 10:
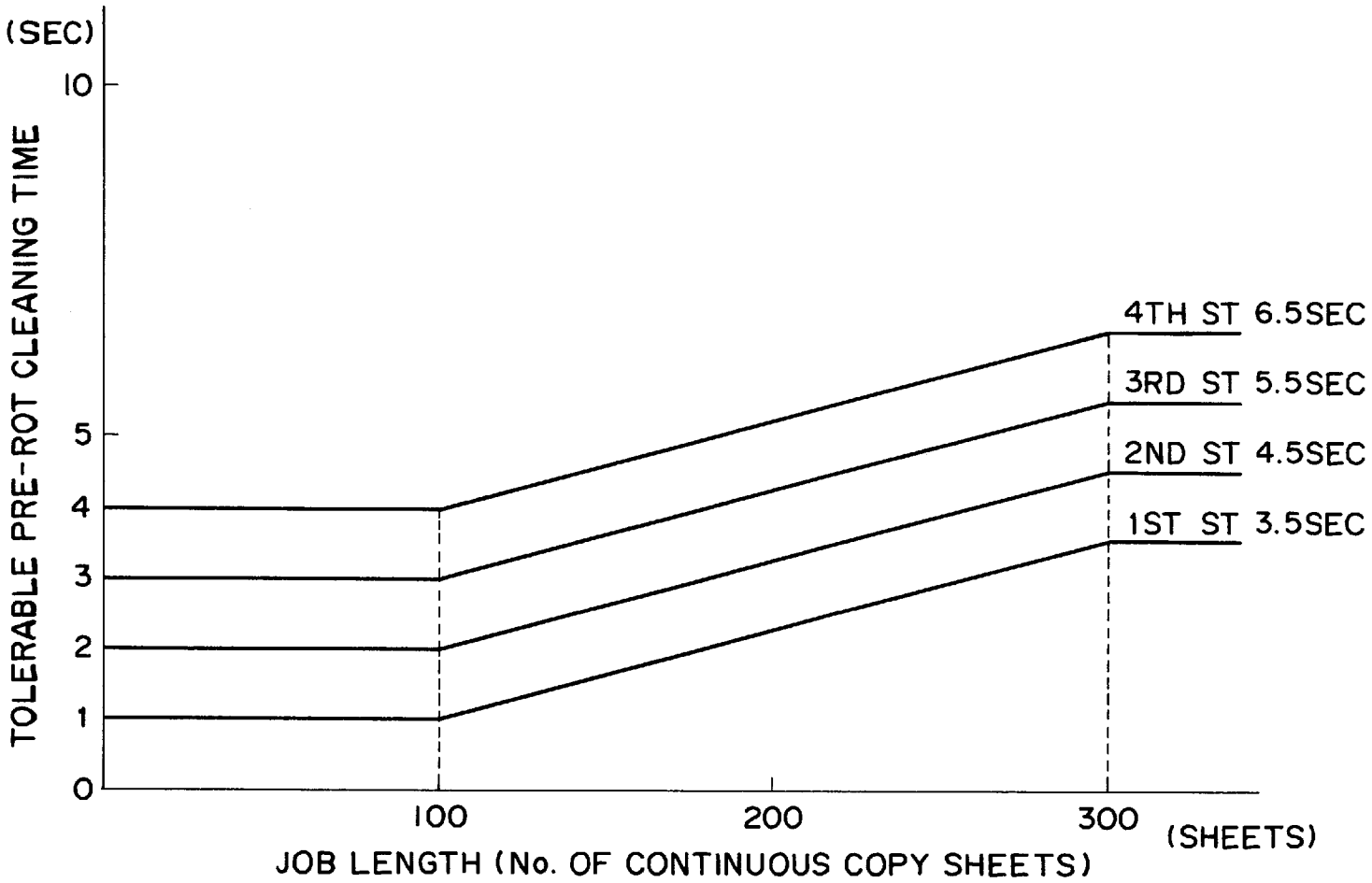
FIG. 10 is a graph which depicts the relationship between the job length and the time allowed for pre-rotation cleaning.
Figure 11:
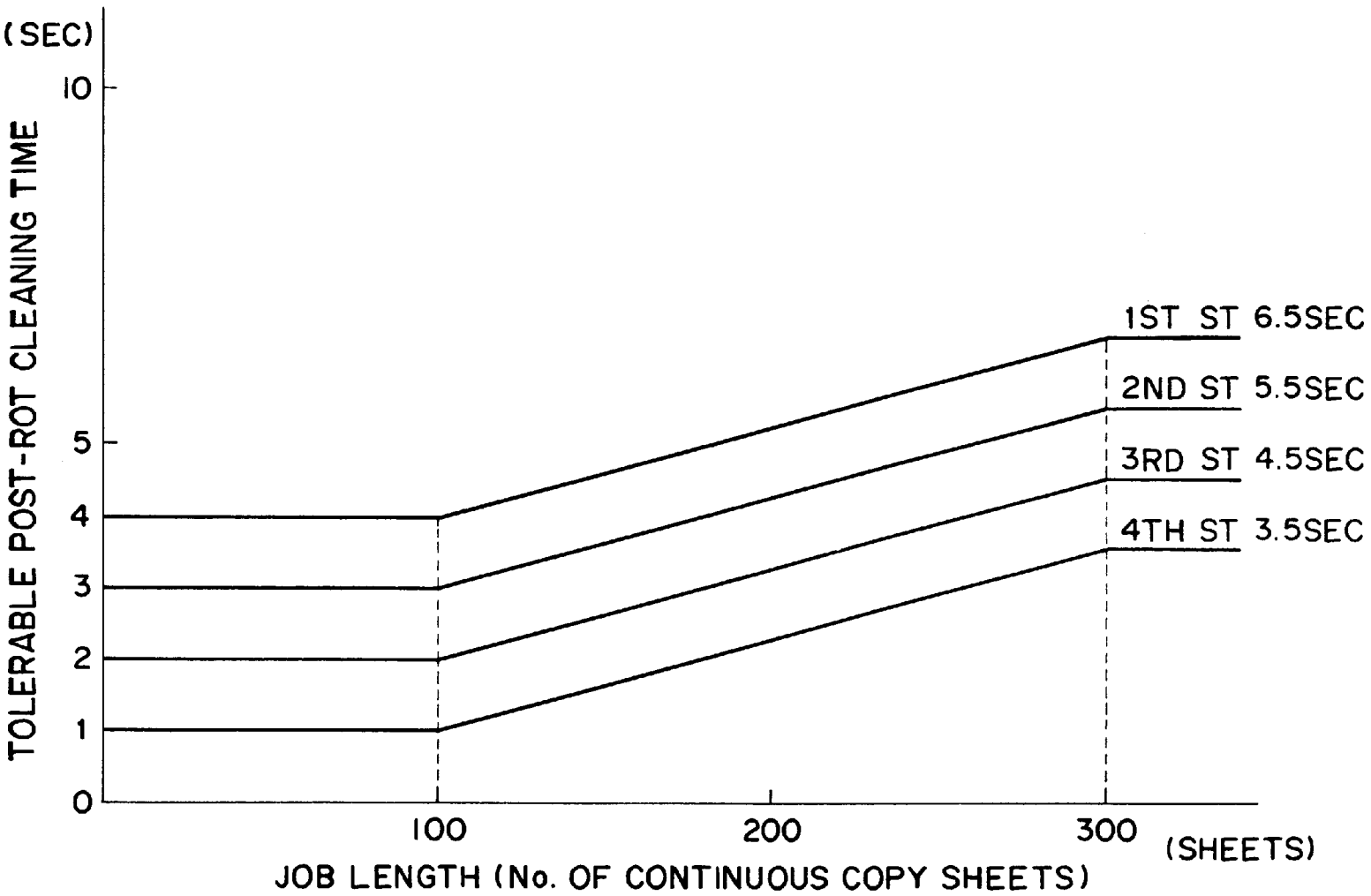
FIG. 11 is a graph which depicts the relationship between the job length and the time allowed for the post-image formation rotation cleaning.
Figure 12:
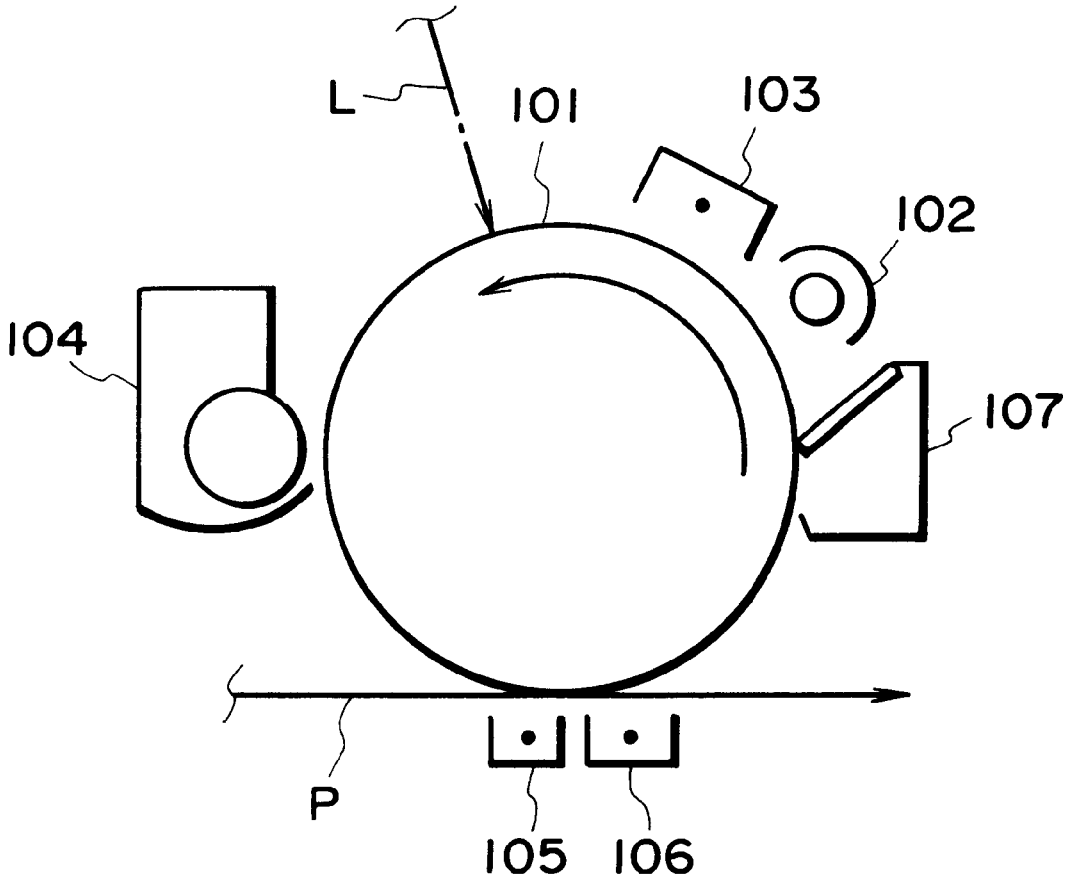
FIG. 12 is a schematic vertical section of a conventional image forming apparatus, and depicts the general structure of the apparatus.

FIG. 10 shows the length of time (during the pre-image formation rotation) allowed for cleaning the magnetic brush type charging device immediately before starting the image formation cycle for the first copy of the next job (before starting to charge the photosensitive drum 1 for image formation). For the reasons described above, the higher the station in terms of ordinal number, the longer the time allowed for cleaning. FIG. 11 shows the length of time (during the post-image formation rotation) allowed for cleaning the magnetic brush type charging device immediately after the ending of the image transfer onto the last transfer medium in a single job (after the charging of the photosensitive drum 1 for image formation is ended). Also for the reason described above, the lower the station in terms of ordinal number, the longer the time allowed for cleaning. In FIGS. 10 and 11, the job length means the number of copies to be continuously printed as a single external printing start signal is inputted into the image forming apparatus. The job length is the length of the time spent for the actual printing operation. Thus, the longer the time allowed for cleaning becomes, the longer the waiting time between two jobs becomes. In this embodiment, however, an arrangement is made so that cleaning time is increased as the number of continuously printed copies increases. Therefore, cleaning time per copy does not increase as much.

As described above, the length of cleaning time is determined based on-job length (number of continuously printed copies). The length of necessary cleaning time shown in FIG. 8 is calculated for each station, based on cumulative image formation data per job. The length of time allowed for cleaning during the pre-image formation rotation (length of time allowed for cleaning the charging device immediately before starting to charge the photosensitive member for image formation), and the length of time allowed for cleaning during the post-image formation rotation (length of time allowed for cleaning the charging device immediately after ending to charge the photosensitive member for image formation), are determined from FIGS. 10 and 11. In this embodiment, a higher priority is given to the cleaning carried out during the post-image formation rotation, and the insufficiency in cleaning time which occurs during the post-image formation rotation is compensated for during the pre-image formation rotation. In other words, except for the station with the largest amount of the cumulative image formation data, in the case of the stations on the upstream side of the station with the largest amount of the cumulative data, the length of the time allowed for cleaning the charging device during the post-image formation rotation is increased by the length proportional to the interval between the adjacent two stations, whereas the length of time allowed for cleaning the charging device during the pre-image formation rotation is reduced by the length proportional to the interval between the adjacent two stations. In the case of the stations on the downstream side of the station with the largest amount of the cumulative data, the length of the time allowed for cleaning the charging device during the post-image formation rotation is reduced by the length proportional to the interval between the adjacent two stations, whereas the length of time allowed for cleaning the charging device during the pre-image formation rotation is increased by the length proportional to the interval between the adjacent two stations. However, if the adjusted length of time allowed for cleaning the charging device is less than the length of time shown in FIGS. 10 and 11 as the length of time allowed for cleaning the charging device when the job length is zero, the cleaning operation is carried out for the length of time equal to the length of time allowed for cleaning when the job length is zero.

If the length of time necessary for cleaning the charging device is within the length set for cleaning, the operation for cleaning the charging device is carried out only for the length of time. However, if the length of time necessary for cleaning the charging device exceeds the length of time set for cleaning, the cleaning operation is carried out only for the duration of the length of time set for cleaning, and the difference between the necessary and set lengths of time for cleaning is carried over to be added to the length of time necessary to clean the charging device after the following job, or the amount of the cumulative image formation data calculated for the following job is increased by the amount equivalent to the length of time for cleaning, which is carried over from the preceding job. However, if the cumulative amount of image formation data for each copy within a single job exceeds 300 units, the cleaning operation for the charging device is carried out for 10 seconds before an image is formed on the following transfer medium, in spite of the fact that copies are supposed to be continuously made. This procedure prevents the photosensitive drum 1 from being charged to a potential level lower than the level below which fog is generated. In this case, the memory in which the cumulative amount of image formation data is stored is reset to zero each time the cleaning operation is carried out during a single job sequence.

Further, if the cumulative amount of image formation data exceeds 30 units during a single job, the cleaning operation may be carried out for a predetermined substantial length of time (longer than 10 seconds) after the end of the job, regardless of the number of copies continuously printed in the job, so that the toner in the charging device is reduced by a substantial amount. Further, in this embodiment, the length of time allowed for the stations other than the station which requires the longest time for cleaning the charging device are determined based on the length of time which requires the longest time for cleaning the charging device. However, an arrangement may be made so that the operations for cleaning the charging device at all stations are carried out within the set length of time. Further, in a monochromatic mode, or a mode with specific color requirement, the cleaning operation does need to be carried out in the stations in which the image formation process is not performed. When the above described procedures are carried out alone or in a proper combination, the photosensitive drum is prevented from being charged to a potential level below the level, below which fog is generated.

In this embodiment, the cleaning sequence is enabled to be carried out during the pre-image formation rotation of the photosensitive member, as well as the post-image formation rotation of the photosensitive member. However, the cleaning sequence may be carried out only during the post-image formation rotation of the photosensitive drum.

In the case of the latter, the more downstream the position of a station, the shorter the time available for the station to clean the charging device, as shown in FIG. 11. The ratio of the length of time necessary for cleaning shown in FIG. 8, relative to the length of time available for cleaning shown in FIG. 11 (necessary length of time for cleaning/available length of time for cleaning) is calculated for each station to determine the station which requires the longest time for cleaning, and then, first, the length of the cleaning time allowed for the station with the largest value in the above ratio is determined as in the preceding example.

In the cases of the stations other than the station with the largest ratio, in other words, in the cases of the stations on the upstream side of the station with the largest ratio, the length of the time allowed for cleaning the charging device during the post-image formation rotation is increased by the length proportional to the interval between the adjacent two stations, whereas in the cases of the stations on the downstream side of the station with the largest ratio, the length of the time allowed for cleaning the charging device during the post-image formation rotation is reduced by the length proportional to the interval between the adjacent two stations. Otherwise, this embodiment may be carried out in the same manner as the preceding embodiment.

In this embodiment, the cleaning sequence is not carried out during the pre-image formation rotation of the photosensitive drum, and therefore, the time spent for printing the first copy is shorter.

FIG. 9 illustrates a full-color image forming apparatus in which the image formed on the photosensitive drum is directly transferred onto a piece of transfer medium such as a sheet of paper. However, the image formed on the photosensitive member may be first transferred onto an intermediate transferring member, and then, may be transferred from the intermediary transferring member to the transfer medium.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image;

transfer means for transferring the toner image from said image bearing member onto a transfer material;

a charging member for contacting to a surface of said image bearing member from which residual toner is not removed to electrically charge said image bearing member, said charging member being capable of temporarily collecting the residual toner;

cleaning means for applying, to said charging member, a cleaning voltage for returning the residual toner to such an area of said image bearing member as is going to be a non-image area, the cleaning voltage being different from a charging voltage which is applied to an area of said image bearing member as is going to be an image area;

image forming means for forming an electrostatic image on said image bearing member having been charged by said charging member;

developing means for developing the electrostatic image on said image bearing member and for collecting the residual toner from said image bearing member; and control means for controlling said cleaning means to vary a cleaning condition of said charging member.

2. An apparatus according to claim 1, wherein said control means controls the cleaning condition in accordance with a number of image forming operations in one job.

3. An apparatus according to claim 1, wherein said control means controls the cleaning condition in accordance with an amount of toner consumption.

4. An apparatus according to claim 3, further comprising integrating means for integrating a number of image data, and said control means controls said cleaning means in accordance with the integrated number.

5. An apparatus according to claim 4, further comprising a plurality of image forming stations each having said image bearing member, an integrating means for integrating a number of image data in each station, and said control means controls the cleaning condition at each image forming station in accordance with a maximum integrated number.

6. An apparatus according to claim 1, wherein said control means controls a time period during which said cleaning means applies the cleaning voltage to said charging member.

7. An apparatus according to claim 1, wherein said charging member is supplied with a voltage in the form of a DC voltage biased with an AC voltage, wherein the cleaning voltage is zero or smaller than the charging voltage.

8. An apparatus according to claim 1, wherein said charging member has a layer of particles contacted to said image bearing member.

* * * * *

UNITED STATES PATENT AND TRADEMARK OFFICE

CERTIFICATE OF CORRECTION

PATENT NO. : 6,215,967 B1
DATED : April 10, 2001
INVENTOR(S) : Atsushi Takeda et al.

It is certified that error appears in the above-identified patent and that said Letters Patent is hereby corrected as shown below:

Title page,
Item [56], References Cited: "5,937,245 * 9/1999 Inoue et al." should read -- 5,937,245 * 8/1999 Inoue et al. --.
Item [75], Inventors: "Shizuoka-ken" should read -- Suntoh-gun --.

Drawings:
In Fig. 6, "RESIOUAL" should read -- RESIDUAL --.

Column 2,
Line 41, "conona" should read -- cornoa --.

Column 3,
Line 8, "of" (first occurrence) should be deleted;
Line 62, "the" should be deleted; and
Line 64, "wards," should read -- words, --.

Column 4,
Line 58, "spend" should read -- spent --.

Column 9,
Line 61, "above described" should read -- above-described --.

Column 10,
Line 36, "a" (second occurrence) should be deleted; and
Line 43, "0.3 μ" should read -- 0.3 μm --.

Column 11,
Line 58, "is" should be -- be --.

Column 14,
Line 25, "being" should read -- is being --.

Column 16,
Line 42, "Which" should read -- which --.

Column 17,
Line 17, "it" should read -- it is ---; and
Line 51, "produce" should read -- produces --.

UNITED STATES PATENT AND TRADEMARK OFFICE

CERTIFICATE OF CORRECTION

PATENT NO. : 6,215,967 B1
DATED : April 10, 2001
INVENTOR(S) : Atsushi Takeda et al.

It is certified that error appears in the above-identified patent and that said Letters Patent is hereby corrected as shown below:

Column 18,
Line 25, “above described” should read -- above-described --.

Column 19,
Line 5, “Image” should read -- image --; and
Line 12, “above described” should read -- above-described --.

Column 21,
Line 55, “on-job” should read -- on job --.

Column 23,
Line 4, “above” should read -- above --; and
Line 5, “carried out” should read -- performed --.:

Signed and Sealed this

Sixth Day of August, 2002

*Attest:*

*Attesting Officer*

JAMES E. ROGAN
*Director of the United States Patent and Trademark Office*